US006715849B2

(12) United States Patent
Fink

(10) Patent No.: US 6,715,849 B2
(45) Date of Patent: Apr. 6, 2004

(54) STORAGE AND DISPLAY TABLE

(76) Inventor: Thomas Andrew Fink, 1050 W. Dorothy La., Apartment 3, Kettering, OH (US) 45409

( * ) Notice: Subject to any disclaimer, the term of this patent is extended or adjusted under 35 U.S.C. 154(b) by 81 days.

(21) Appl. No.: 09/970,832

(22) Filed: Oct. 4, 2001

(65) Prior Publication Data

US 2003/0071545 A1 Apr. 17, 2003

(51) Int. Cl.[7] ..... A47F 3/00
(52) U.S. Cl. ..... 312/122; 312/234.2
(58) Field of Search ..... 312/114, 117, 312/122, 234.3, 234.2, 234.5; 108/26, 25, 184, 88

(56) References Cited

U.S. PATENT DOCUMENTS

| | | | | | |
|---|---|---|---|---|---|
| 161,502 | A | | 3/1875 | Gilbert | |
| 224,007 | A | * | 2/1880 | Fay | 108/83 |
| 451,664 | A | * | 5/1891 | Culver | 206/0.83 |
| 881,363 | A | * | 3/1908 | Vickers | 312/234.3 |
| 939,199 | A | | 11/1909 | Baker | |
| 1,094,154 | A | | 4/1914 | Le Furge | |
| 1,483,135 | A | | 2/1924 | Walaschek | |
| 1,487,734 | A | * | 3/1924 | Fay | 312/114 |
| 1,520,188 | A | | 12/1924 | Bouthillier | |
| 2,040,432 | A | * | 5/1936 | Dieman | 108/64 |
| 3,297,375 | A | * | 1/1967 | Reeves | 312/117 |
| 3,554,625 | A | * | 1/1971 | Sly | 312/234 |
| 4,591,215 | A | * | 5/1986 | Robbins | 312/234.3 |
| 4,746,009 | A | * | 5/1988 | Liberman | 206/723 |
| 4,841,878 | A | | 6/1989 | Kriegsman | |
| 4,998,361 | A | * | 3/1991 | Gordon | 40/152 |
| 5,371,963 | A | * | 12/1994 | Gallagher | 40/771 |
| 5,795,090 | A | * | 8/1998 | Jackson | 402/79 |
| D437,504 | S | | 2/2001 | Giron | |
| 6,370,805 | B2 | * | 4/2002 | Thompson | 40/778 |

* cited by examiner

*Primary Examiner*—Janet M. Wilkens

(57) ABSTRACT

A table includes a tabletop that is at least partially constructed of a substantially transparent material allowing a user to see below the lower surface of the tabletop from above the upper surface of the tabletop. The table has one or more storage panels for storing and selectively displaying objects, and a support structure configured to support the tabletop and support the one or more storage panels below the lower surface of the tabletop wherein at least one of the one or more storage panels is visible through the substantially transparent material of the tabletop. The support structure has an opening for removing, installing, and arranging the one or more storage panels. Optional features of the table include a visual identification system for identifying the contents of the storage panels and a modular selection of storage panels for storing and selectively displaying disparate objects.

31 Claims, 21 Drawing Sheets

STORAGE AND DISPLAY TABLE

The present invention relates generally to a table, and more particularly to a table having integral object storage and display capabilities.

BACKGROUND

It is common for people to accumulate treasured objects during their lifetime. These treasured objects often include objects such as photographs, pictures, drawings, and newspaper clippings. Also common are collections of treasured objects such as stamps, coins, and baseball cards.

One currently practiced method for storing and displaying these treasured objects is to place them into storage devices such as photo albums, scrapbooks, or storage cases. This method allows one to display these treasured objects at close range on a table, where guests often gather to enjoy refreshments and conversation. However, because these storage devices are themselves stored in closets, drawers, or the like, manufacturers limit their size. This limited size results in small groupings of treasured objects within these storage devices, thereby limiting arrangement possibilities for the treasured objects. Furthermore, one must retrieve these storage devices from storage for display and return them to storage after display.

Another method for storing and displaying these treasured objects is to place them into picture frames, which are hung on walls or set on furnishings. With this method, objects are on display continuously, so there is no need to retrieve the objects from storage for display and return the objects to storage after display. Picture frames hung on walls offer an increased area for arranging treasured objects, which increases arrangement possibilities. However, the use of picture frames to store and display treasured objects can give walls and furnishings a cluttered appearance. Picture frames hung on walls do not allow display of these treasured objects at close range on a table such as a kitchen, dining or coffee table where guests often gather to enjoy refreshments and conversation. Picture frames set on tables often hinder normal uses of tabletops. Therefore, they are more commonly set on dressers, nightstands, bookshelves, display cabinets, or desks, which are not often gathering spots for guests to enjoy refreshments and conversation. Outside of their ability to store and display treasured objects, picture frames often lack functionality.

Yet another method of storing and displaying these treasured objects is to lay them on a tabletop and cover them with a sheet of glass. With this method, objects are on display continuously, so there is no need to retrieve the objects from storage for display and return the objects to storage after display. The large size of the display area increases arrangement possibilities. This method allows one to display treasured objects at close range at a table where guests often gather to enjoy refreshments and conversation. Furthermore, storing and displaying treasured objects in a table is efficient because a table is a functional device that is commonly found in the home. However, this method has its disadvantages. Accessing treasured objects is difficult due to the size and weight of the glass sheet. The arrangement of the objects is often disturbed during installation and removal of the glass sheet. Because these treasured objects simply lie on the tabletop, one must remove the existing treasured objects individually and individually add and arrange new treasured objects. This makes it difficult and time consuming to change the display of existing treasured objects to a new set of treasured objects. Also, because the objects simply lie on the tabletop, it is not practical to store more than one layer of treasured objects on the tabletop. Therefore, storage capacity is essentially limited to the area of the tabletop when using this method.

After the preceding examination of methods used to store and display treasured objects, it is clear that the devices used in these methods have inherent disadvantages. Therefore, a need exists for an invention that overcomes the inherent disadvantages of these devices, thereby providing an improved device for storing and displaying treasured objects.

SUMMARY

The present invention satisfies the need for an improved device for storing and displaying treasured objects. Accordingly, the present invention has several objects and advantages including:

(a). to provide storage and display of treasured objects at a tabletop where guests often gather to enjoy refreshments and conversation;

(b). to provide a large display area for treasured objects, which increases arrangement possibilities;

(c). to provide a storage and display device suitable for many disparate objects, for example coins, photographs, stamps, trading cards, and other relatively thin objects;

(d). to provide a table that is capable of storing and displaying relatively thin, treasured objects without disrupting the function of the table;

(e). to provide a storage and display table whose embodiments can take the form of many different kinds of tables, for example kitchen, dining, or coffee tables;

(f). to provide storage for relatively thin, treasured objects, thereby allowing traditional storage areas, such as closets, drawers, cabinets, and shelves to be utilized for storing other items;

(g). to provide a display area for relatively thin, treasured objects, thereby allowing traditional display areas such as tabletops, countertops, furnishings, shelves, and walls to be less cluttered or to be utilized for displaying other items;

(h). to provide an apparatus for displaying relatively thin, treasured objects that allows a user to quickly and easily change the displayed objects from one set of objects to another set of objects;

(i). to provide an apparatus capable of safely and conveniently storing multiple layers of relatively thin, treasured objects;

(j). to provide a storage and display apparatus that is integrated into a functional and commonly used device, namely a table; and (k). to provide a storage and display apparatus that allows easy, convenient access to objects.

Further objects and advantages of the present invention include:

(l). to provide a visual identification system for quickly and easily identifying a selected set of objects;

(m). to provide a storage and display table that is expandable;

(n). to provide a table which has a modular storage and display system; and (o). to provide a modular selection of storage panels for storing disparate objects.

The present invention does not require that all the objects and all the advantages need to be incorporated into every embodiment of the present invention.

A table having features of the present invention comprises a tabletop having an upper surface and an opposite lower surface. The tabletop is at least partially constructed of a substantially transparent material allowing a user to see below the lower surface of the tabletop from above the upper surface of the tabletop. The table has one or more storage panels for storing and selectively displaying objects, and a support structure configured to support the tabletop and support the one or more storage panels below the lower surface of the tabletop wherein at least one of the one or more storage panels is visible through the substantially transparent material of the tabletop. The support structure has an opening allowing the user to remove and install the one or more storage panels to manage the objects thereon and to arrange the one or more storage panels to selectively display the objects through the substantially transparent material of the tabletop.

DRAWING FIGURES

These and other features, aspects, objects, and advantages of the present invention will become better understood with regard to the following description, appended claims, and accompanying drawings, where:

FIG. 1 shows a perspective view of a kitchen table embodiment of the present invention.

FIG. 2 shows a perspective view of the kitchen table of FIG. 1 with the topmost storage panel partially removed.

FIG. 3 shows an enlarged view of the retainer of FIG. 2.

FIG. 4 shows a side view of the kitchen table of FIG. 1.

FIG. 5 shows a top view of the retainer.

FIG. 6 shows a top view of the first type of a storage panel.

FIG. 7 shows a sectional view of the first type of storage panel.

FIG. 8 shows an enlarged view of FIG. 7.

FIG. 9 shows another enlarged view of FIG. 7.

FIG. 10 shows a sectional view of the first type of storage panel with the transparent plastic film covering displaced.

FIG. 11 shows a front view of the first type of storage panel with the transparent plastic film covering displaced.

FIG. 12 shows the top view of the pad of paper.

FIG. 13 shows a side view of the pad of paper.

FIG. 14 shows the top view of the second type of storage panel.

FIG. 15 shows a sectional view of the second type of storage panel.

FIG. 16 shows a top view of the third type of storage panel.

FIG. 17 shows a sectional view of the third type of storage panel.

FIG. 18 shows a perspective view of an expandable dining table embodiment of the present invention with the table fully expanded and the tabletop expansion insert installed.

FIG. 19 shows a perspective view of the expandable dining table of FIG. 18 with the table fully expanded, without the tabletop expansion insert installed, and with a storage panel partially removed from the table.

FIG. 20 shows a bottom view of the expandable dining table of FIG. 18.

FIG. 21 shows a side view of the expandable dining table of FIG. 18.

FIG. 22 shows an end view of the expandable dining table of FIG. 18.

FIG. 23 shows a side view of the expandable dining table of FIG. 18 in an unexpanded configuration.

FIG. 24 shows an end view of the expandable dining table of FIG. 18 in an unexpanded configuration.

FIG. 25 shows a top end view of the expandable dining table of FIG. 18 in an unexpanded configuration.

FIG. 26 shows a sectional view of the expandable dining table shown in FIG. 25.

FIG. 27 shows a top view of a storage panel.

FIG. 28 shows a sectional view of the storage panel of FIG. 27.

FIG. 29 shows an expanded view of FIG. 28.

FIG. 30 shows a front view of two of the storage panels.

FIG. 31 shows a top view of the paper.

FIG. 32 is a perspective view of a coffee table embodiment of the present invention.

FIG. 33 is a perspective view of the coffee table of FIG. 32 with the topmost storage panel partially removed from the coffee table.

FIG. 34 is an end view of the coffee table of FIG. 32.

FIG. 35 is a side view of the coffee table of FIG. 32.

FIG. 36 is a top view of one of the storage panels.

FIG. 37 is a sectional view of the storage panel shown in FIG. 36.

Reference Numerals Used in Drawings

Figure 1:
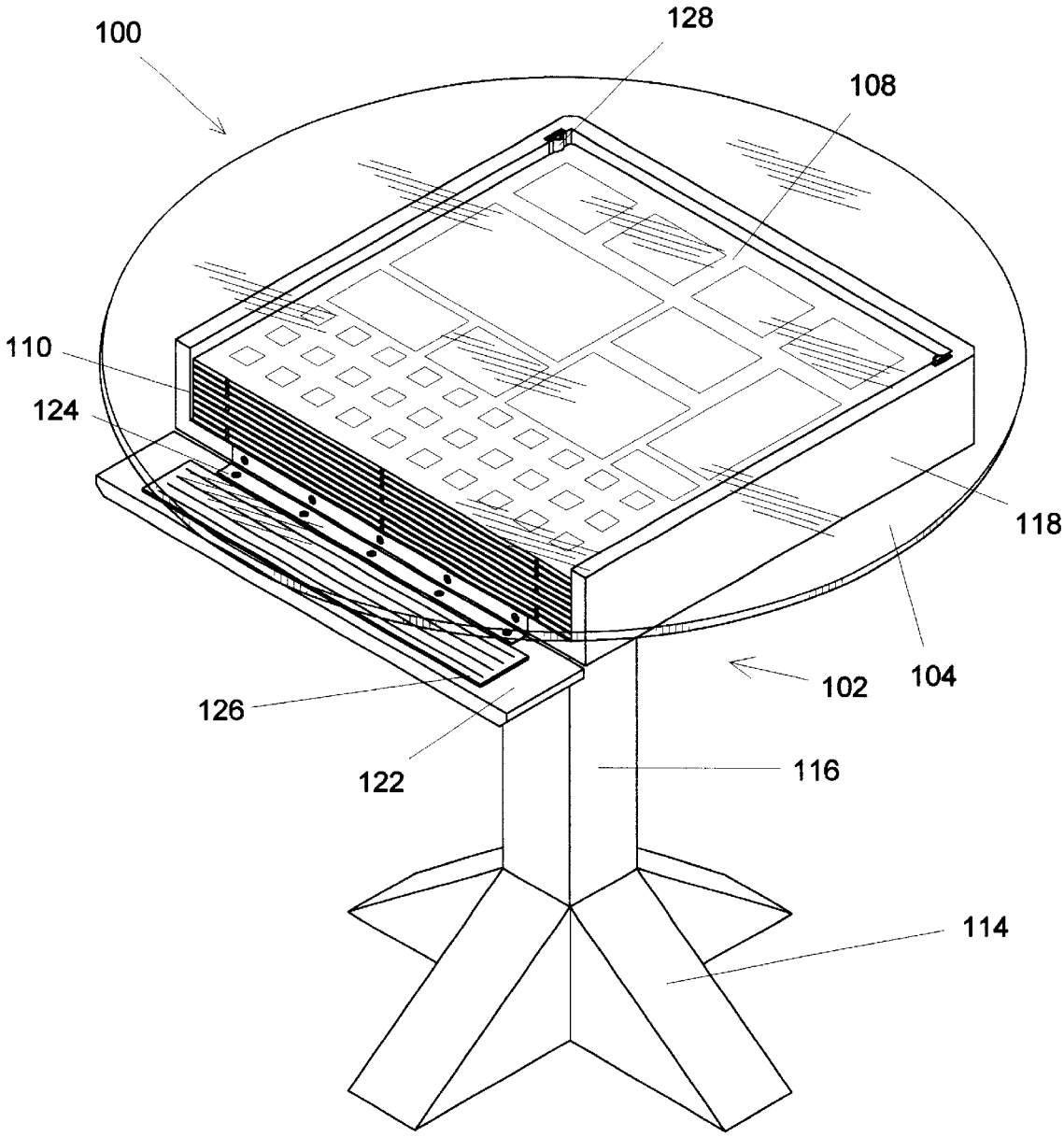
FIGS. 1 to 17 show various aspects of a kitchen table embodying preferred features of the present invention.

| | | | |
|---|---|---|---|
| 100 | a kitchen table embodiment | 102 | support structure |
| 104 | substantially transparent tabletop | 106 | storage panels |
| 106' | first type of storage panel | 106" | second type of storage panel |
| 106''' | third type of storage panel | 108 | topmost storage panel |
| 110 | opening | 111 | upper surface of tabletop |
| 112 | lower surface of tabletop | 113 | transparent coating |
| 114 | base | 116 | center post |
| 118 | panel housing | 120 | bracing |
| 122 | door | 124 | hinge |
| 126 | description display (pad of paper) | 128 | retainer |
| 130 | flexible bulb | 132 | retainer housing |
| 134 | notch | 136 | rounded corner |
| 138 | object (photograph) | 140 | backing |
| 142 | transparent plastic film covering | 143 | adhesive |
| 144 | center support | 145 | adhesive |
| 146 | archival photo-mount board | 147 | side of storage panel |
| 148 | concave dimple | 149 | side of storage panel |
| 150 | front edge of backing | 152 | end of transparent plastic film covering |
| 154 | dimple | 156 | rear edge of backing |
| 158 | backing | 159 | adhesive |

-continued

| Reference Numerals Used in Drawings | | | |
|---|---|---|---|
| 160 | pocket display assembly | 161 | bond |
| 162 | opaque plastic film | 164 | transparent plastic film cover |
| 166 | opening | 167 | side of storage panel |
| 168 | pocket | 169 | side of storage panel |
| 170 | object (baseball card) | 172 | object (coin) |
| 174 | backing | 175 | adhesive |
| 176 | coin retention layer | 177 | hole |
| 178 | first visual identifier (orange sticker) | 178' | corresponding second visual identifier |
| 180 | first visual identifier (green sticker) | 180' | corresponding second visual identifier |
| 181 | blank area | 182 | written description |
| 184 | binding | 186 | page |
| 188 | adhesive | | |
| 200 | an expandable dining table embodiment | 202 | identical halves of table |
| 204 | interlocking support rails | 206 | tabletop expansion insert |
| 208 | support structure | 209 | upper surface of tabletop |
| 210 | tabletop | 211 | lower surface of tabletop |
| 212 | storage panels | 212' | storage panel |
| 214 | leg | 216 | panel housing |
| 218 | rack | 220 | opening |
| 222 | door | 224 | hinge |
| 226 | wooden frame | 228 | glass |
| 230 | topmost storage panel | 232 | outer support rail |
| 234 | inner support rail | 236 | description display (piece of paper) |
| 238 | alignment tab (hexagon-head bolt) | 240 | backing |
| 241 | center support | 242 | adhesive |
| 243 | side of storage panel | 244 | archival photo-mount board |
| 245 | side of storage panel | 246 | object adhesive |
| 247 | adhesive | 248 | transparent plastic film cover |
| 250 | rear edge of backing | 252 | object (picture) |
| 254 | front edge of storage panel | 256 | first visual identifier (orange sticker) |
| 256' | corresponding second visual identifier | 258 | first visual identifier (green sticker) |
| 258' | corresponding second visual identifier | 260 | written description |
| 262 | blank area | | |
| 300 | a coffee table embodiment | 302 | support structure |
| 304 | tabletop | 305 | lower surface of tabletop |
| 306 | storage panels | 306' | storage panel |
| 307 | upper surface of tabletop | 308 | topmost storage panel |
| 310 | leg | 312 | side support member |
| 314 | shelf | 316 | opening |
| 318 | end brace | 320 | cap |
| 321 | cylindrical post | 322 | backing |
| 324 | adhesive | 326 | archival photo-mount board |
| 328 | object (photo) | 330 | rack |
| 332 | side of storage panel | 334 | side of storage panel |
| 400 | chair | 401 | tag |
| 402 | thick paper | 404 | a storage panel |
| 406 | string | 408 | blank area |
| 410 | written description of storage panel contents | | |

DESCRIPTION

In order to clearly illustrate features, aspects, objects, and advantages of the present invention, descriptions of three embodiments of the present invention are provided.

Description of a Kitchen Table Embodiment

The preferred embodiment of the storage and display table of the present invention is a kitchen table 100 illustrated in FIGS. 1 to 17. The kitchen table 100 is generally comprised of a support structure 102, a substantially transparent tabletop 104, and a plurality of storage panels 106.

Figure 2:
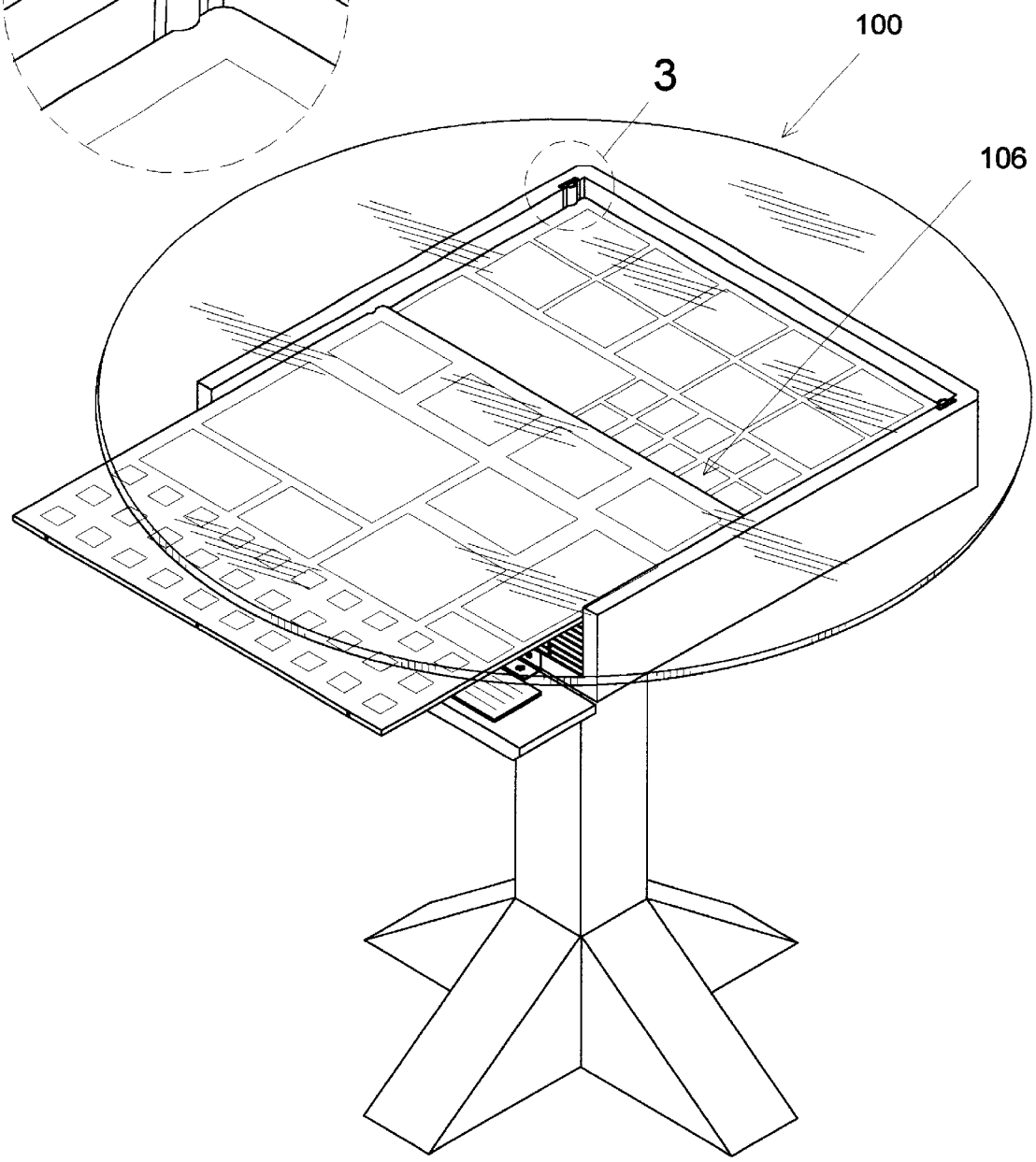
Figure 4:
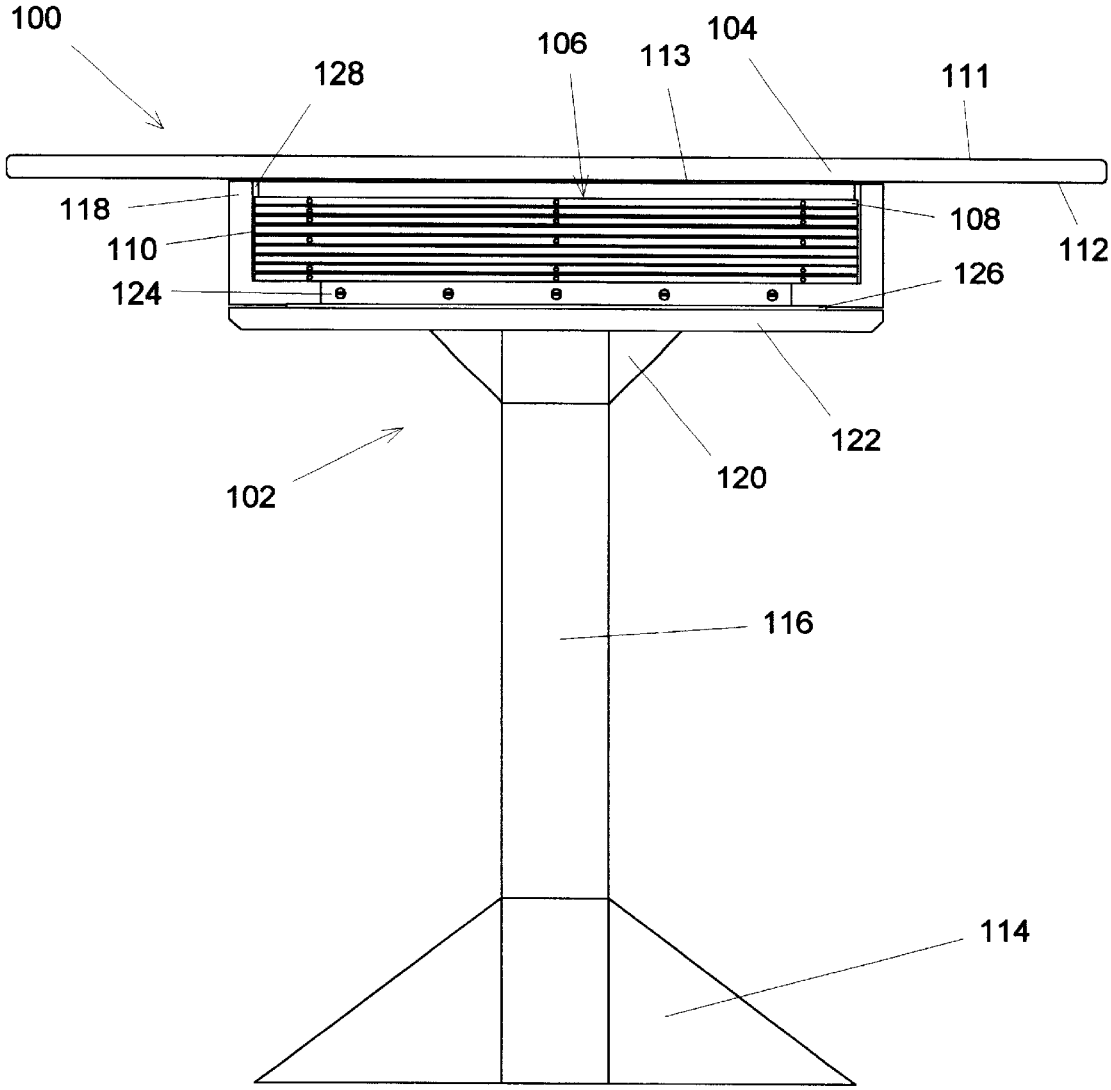

As shown in FIGS. 1, 2, and 4, the support structure 102 includes a base 114, a center post 116, bracing 120, and a panel housing 118. The base is mounted to the center post to provide a stable foundation for the table. The panel housing 118 is mounted to the top of the center post and stabilized with the bracing 120. The panel housing isolates, protects, and supports the storage panels 106 and provides support for the tabletop 104. The panel housing has an opening 110 that allows a user to remove and install the storage panels.

A door 122 provides a cover for the opening. The door is attached with a hinge 124. The hinge is of the type commonly referred to as a friction hinge. This type of hinge allows the door to be held in any desired position from fully open, to fully closed. The hinge is made of steel and all other components of the support structure 102 are made of wood such as oak. However, any suitable materials can be used to construct the components of the support structure, such as other woods, metals, and plastics.

As shown in FIGS. 1, 2, and 4, the substantially transparent tabletop 104 rests on the support structure. The tabletop has an upper surface 111 and an opposite lower surface 112. The transparent tabletop is made of glass. It is preferred that the glass deters ultra violet light from reaching the objects on the storage panels. For example, a transparent coating that deters ultra violet light penetration 113 is applied to the lower surface of the tabletop. Other substantially transparent, rigid materials are suitable for use in constructing the tabletop, such as plastics.

The storage panels 106 are positioned below the lower surface 112 of the tabletop 104. The storage panels include three different types of storage panels. The first type of storage panel 106' is shown in FIGS. 6 to 11. The first type of storage panel 106' is comprised of a backing 140 and a transparent plastic film covering 142. The backing comprises a lightweight, rigid center support 144, such as plywood or hardboard, laminated between two pieces of archival photo-mount board 146, such as 0.060 inch, 100% cotton rag board. The archival photo-mount board is laminated to the center support with adhesive 143. The preferred archival photo-mount board has a PH near neutral to protect objects such as photographs that are stored on the storage panel. The rear corners of the backing 136 are rounded, notches 134 are cut from the backing, and small concave dimples 148 are drilled into the front edge 150 of the backing.

The transparent plastic film covering 142 is formed at an angle of slightly greater than 90 degrees at both ends 152 and dimples 154 are formed in the ends. Any suitable plastic forming process may be used in forming the ends including many of the forming processes typically referred to as thermoforming. Suitable plastics for the transparent plastic film covering include polypropylene, polyethylene, and polyester. The transparent plastic film covering is bonded to the backing with adhesive 145 along the rear edge 156 of the backing, thereby permanently aligning and securing the transparent plastic film covering to the backing.

Figure 14:
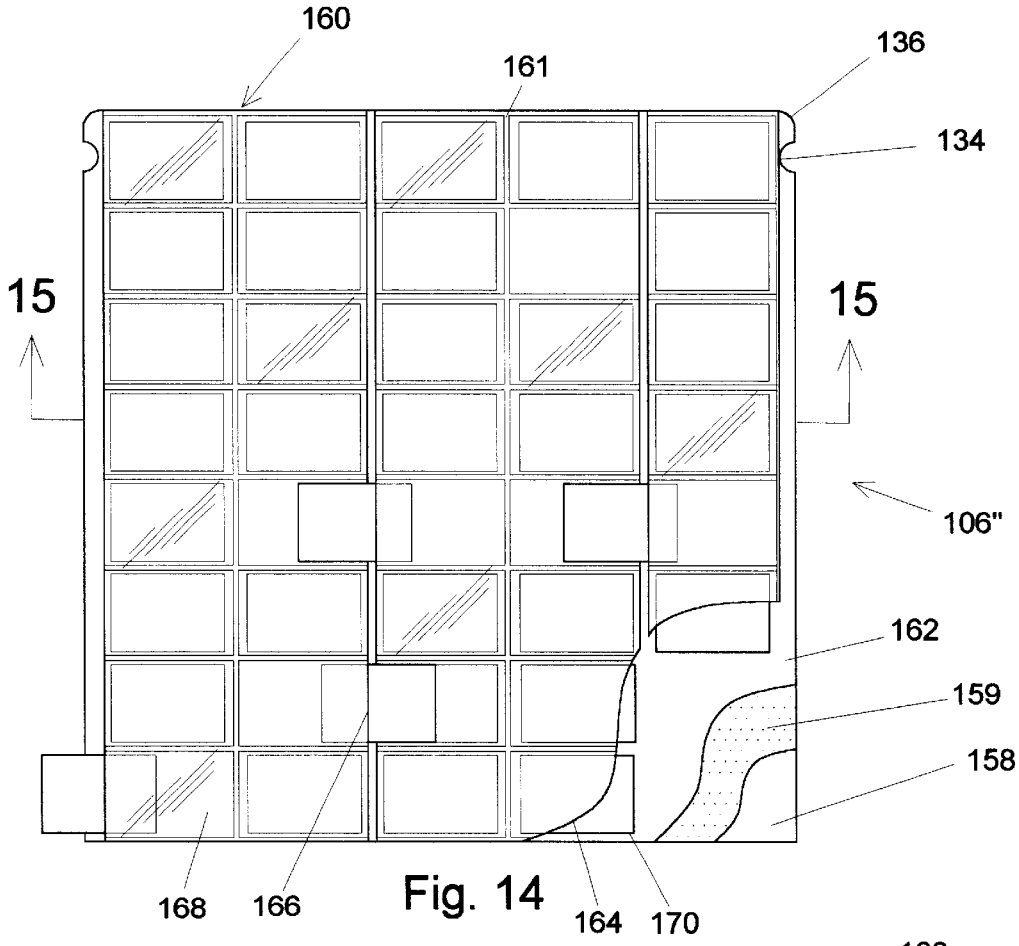
Figure 15:
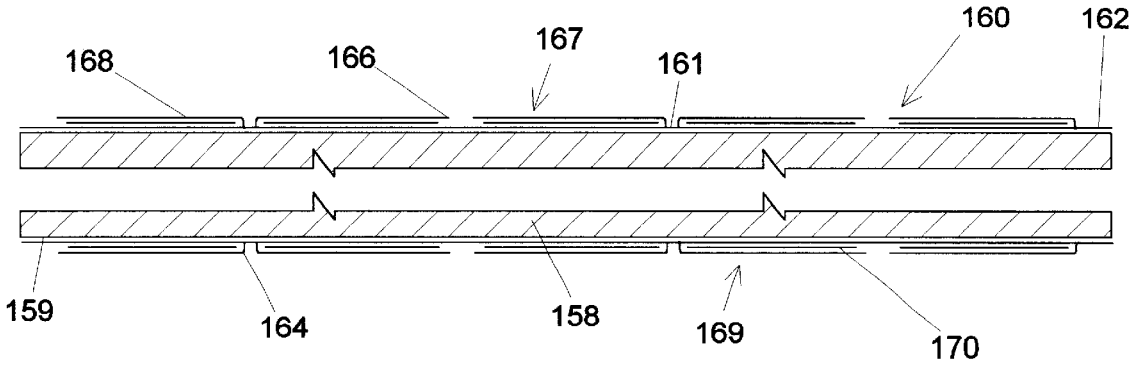

The second type of storage panel 106" is illustrated in FIGS. 14 and 15. This second type of storage panel is comprised of a backing 158, and a pocket display assembly 160. The backing and the pocket display assembly are laminated together using an adhesive 159. The backing is a lightweight, rigid support, such as hardboard or cardboard. The rear corners of the backing 136 are rounded, notches 134 are cut from the backing. The pocket display assembly comprises a layer of opaque plastic film 162, and a plurality of transparent plastic film covers 164. The transparent plastic film covers are bonded 161 to the opaque plastic film in a predetermined pattern. This predetermined pattern results in a plurality of pockets 168 being formed. These pockets have openings 166 for receiving objects for storage. Pockets are sized to receive and store selected objects such as baseball cards 170. Preferred bonding techniques are processes commonly referred to as plastic welding or heat sealing, however, other bonding techniques such as gluing are also suitable. Suitable plastics for the opaque plastic film and the transparent plastic film covers include polypropylene, polyethylene, and polyester.

Figure 16:
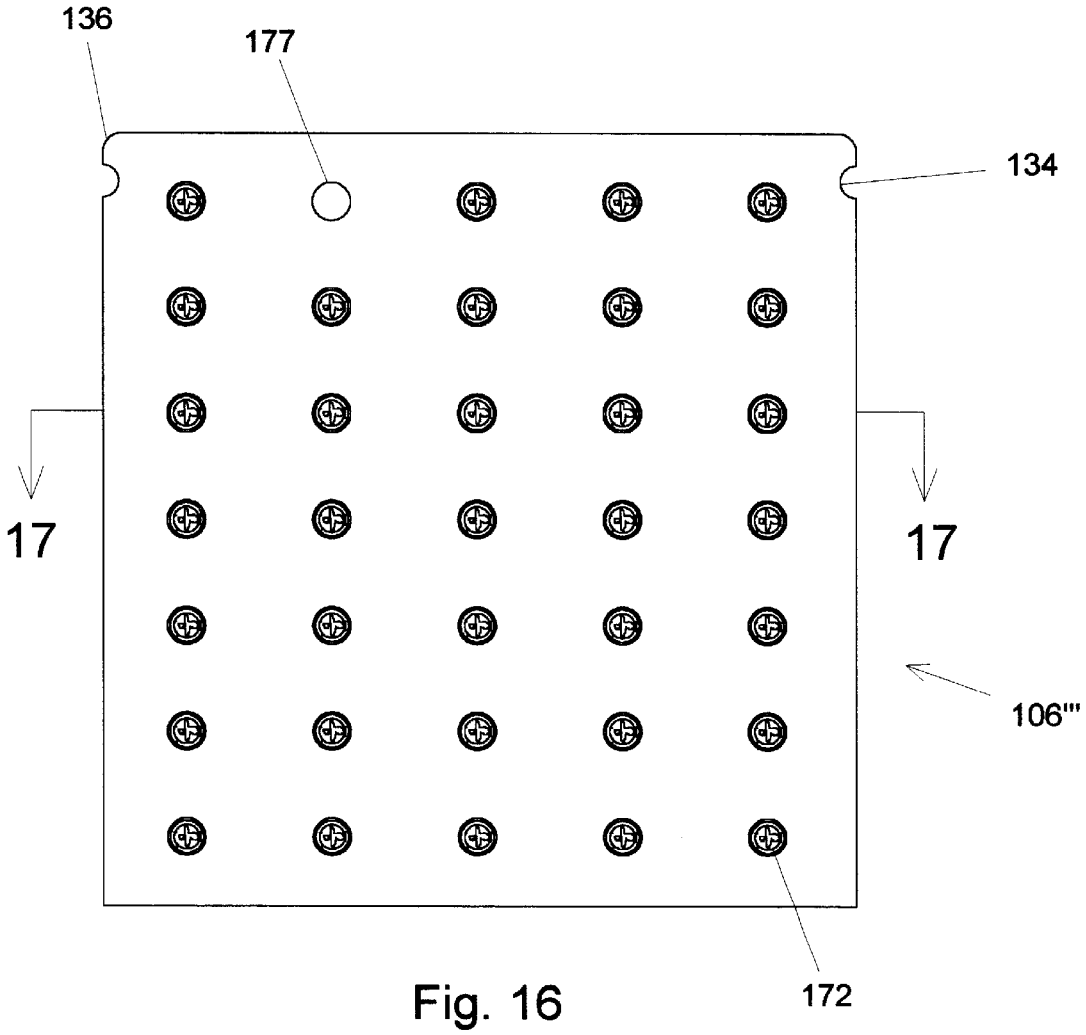
Figure 17:
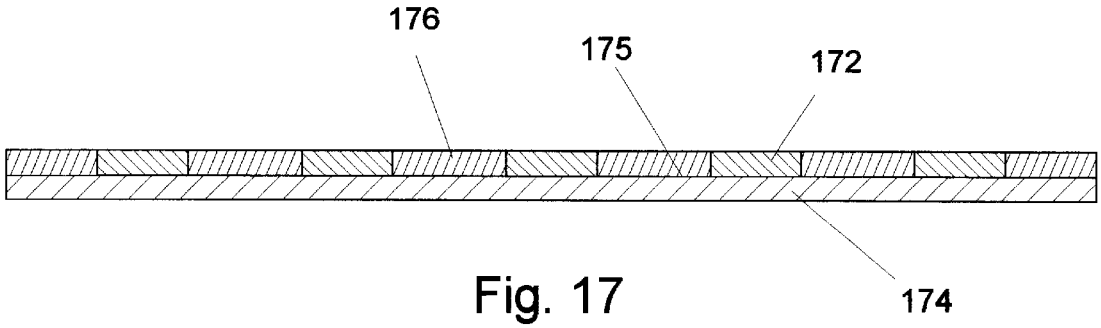

The third type of storage panel 106'" is illustrated in FIGS. 16 and 17. This third type of storage panel is disposed to store coins. The third type of storage panel is comprised of a backing 174 and a coin retention layer 176. The backing is a rigid, planar support such as hardboard or cardboard. The thickness of the backing is chosen to adequately support the type and number of coins 172 to be stored on the backing. The coin retention layer is a rigid, planar material, such as plastic or laminated paper, provided with a plurality of holes 177. The size and shape of these holes is associated with the selected coins to be stored. The holes closely match perimeter of the selected coins. The thickness of the coin retention layer matches the thickness of the selected coins. The backing and the coin retention layer are laminated together with adhesive 175. The rear corners of the backing 136 are rounded, notches 134 are cut from the backing.

Together, these three types of storage panels make up a modular storage system. The user selects any combination of these three types of storage panels that best suites the storage needs of the user. This allows the user to customize the storage and display capabilities of the table by choosing from this modular selection of storage panels.

Figure 3:
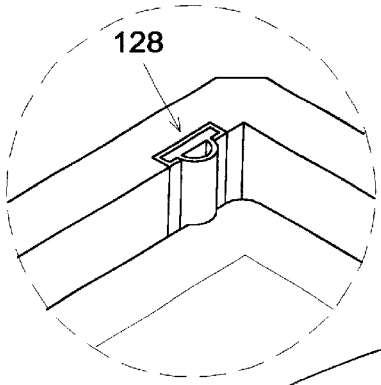
Figure 5:
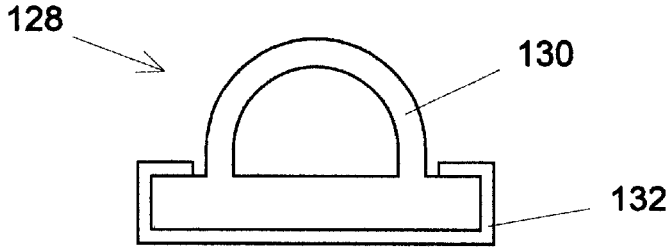
Figure 6:
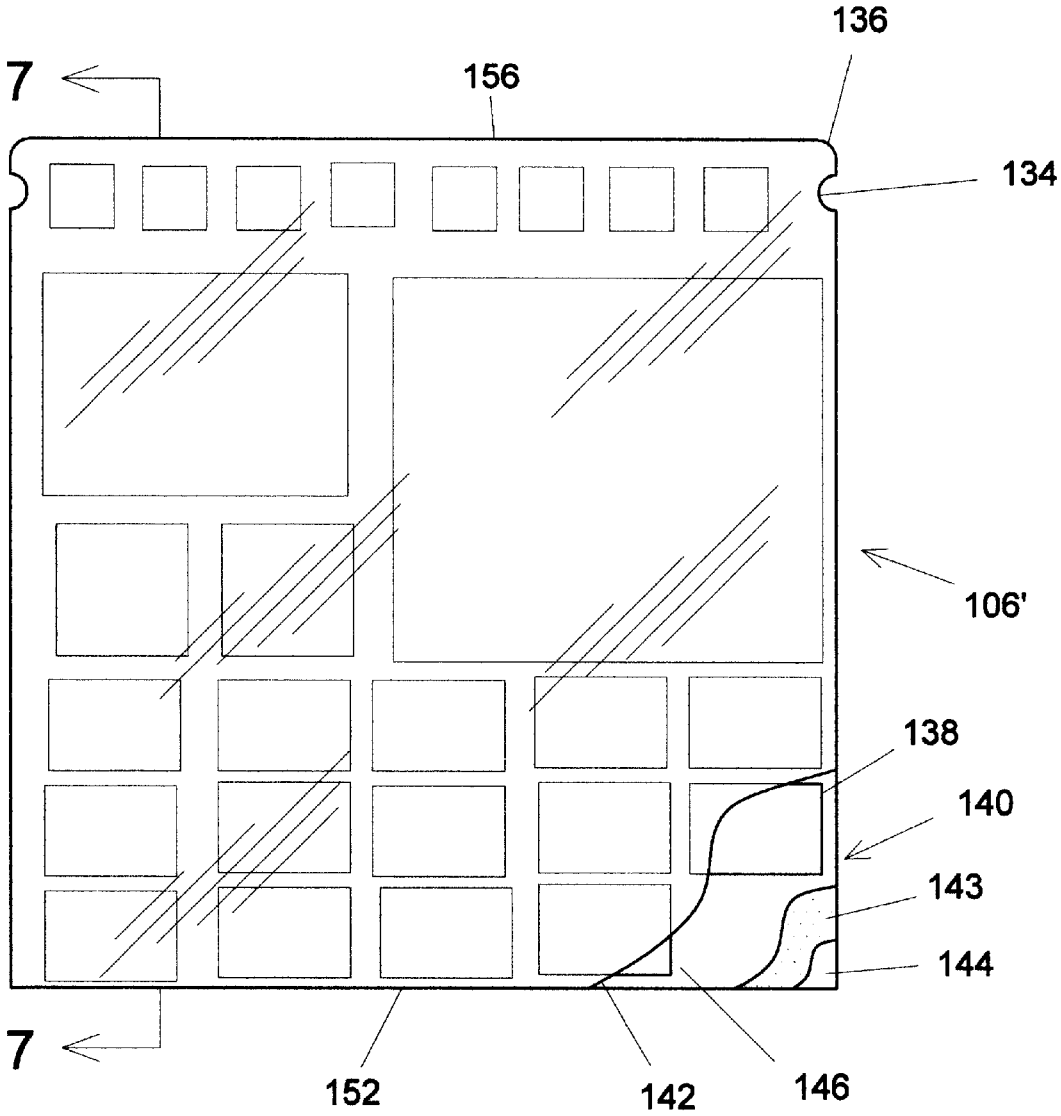
Figure 7:
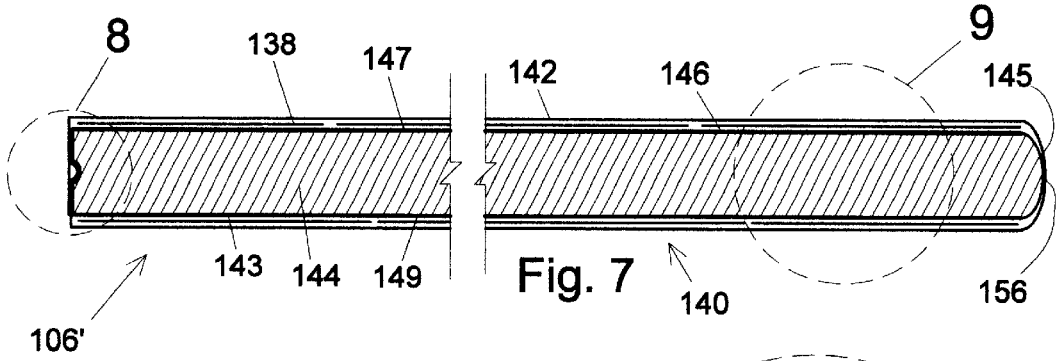

The table is provided with a retainer system. The retainer system allows the user to individually remove a single storage panel without disturbing the position of the other storage panels. For example, FIGS. 2, 3, and 5 show a retainer system that has two identical retainers 128 mounted on the panel housing. The panel housing is routed to recess the two identical retainers. Each of the two identical retainers has a flexible bulb 130 and a retainer housing 132. The flexible bulb is made of a durable, flexible material such as rubber or plastic. The retainer housing is made of metal such as aluminum.

Figure 11:
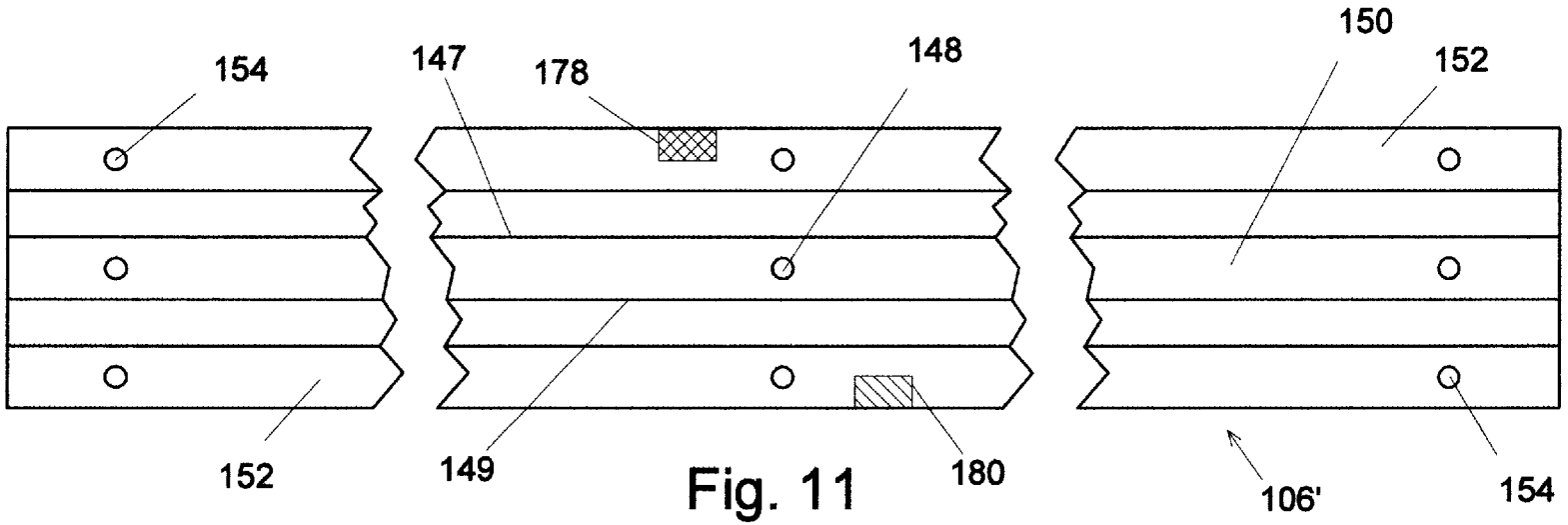
Figure 12:
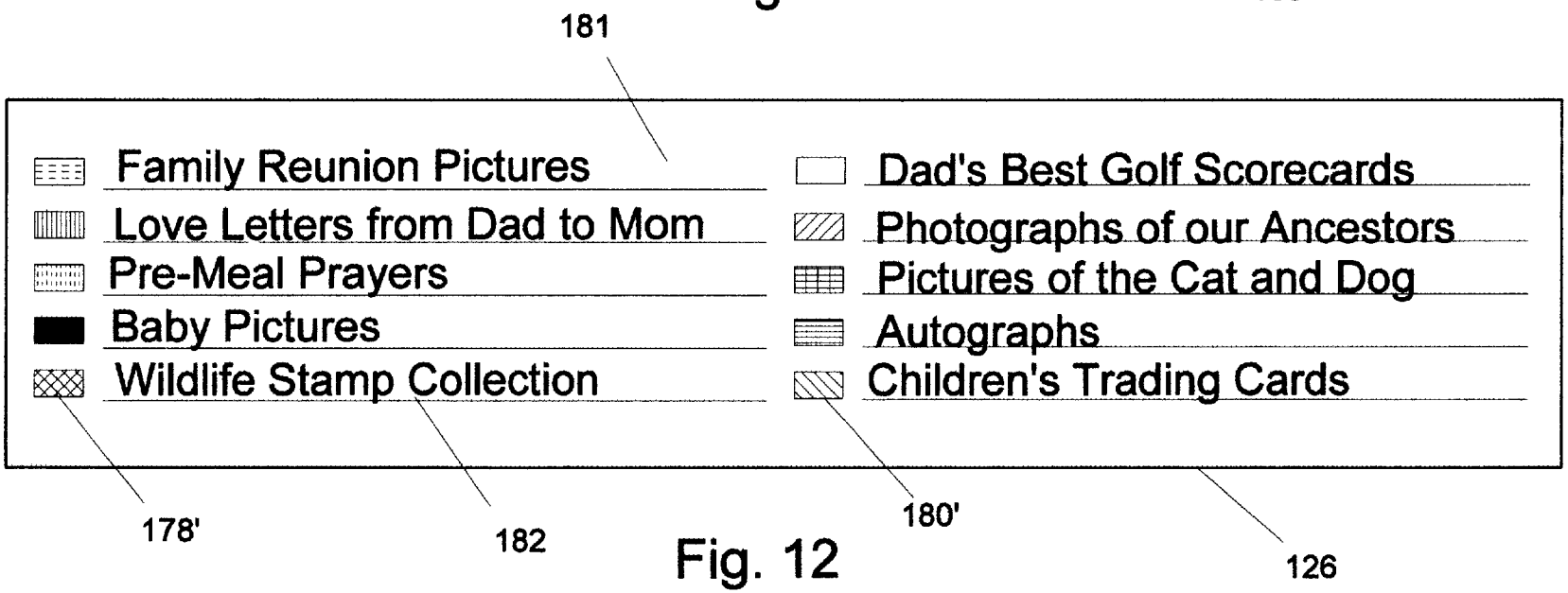
Figure 13:
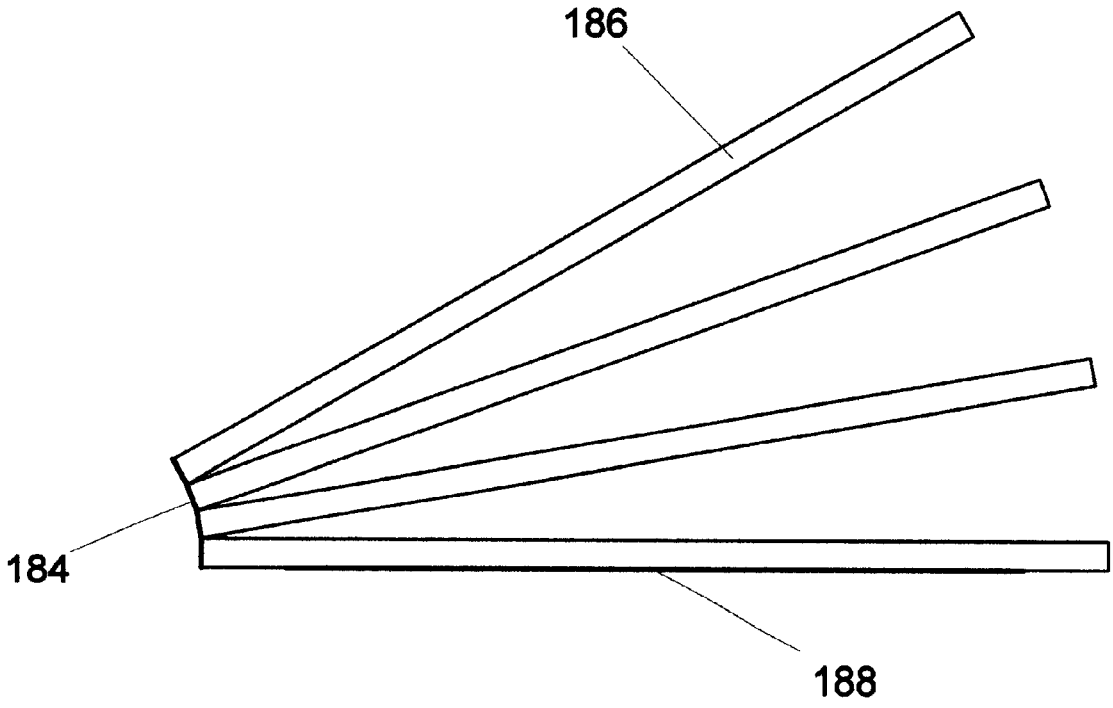

A visual identification system is provided to quickly and easily identify the contents of the storage panels. The visual identification system is comprised of a description display, a plurality of first visual identifiers, and a plurality of corresponding second visual identifiers. The storage panels are provided with a first visual identifier for each side of the storage panel that is designed to store objects. For example, the first type of storage panel is designed to store objects on both sides 147, 149. Therefore, two first visual identifiers are provided, one for each side of the first type of storage panel. The first visual identifiers are attached to, or integrated into the storage panels at or near the front edge of the storage panel. Each first visual identifier has a characteristic, such as color or shape, which distinguishes it from the other visual identifiers. Therefore, the first visual identifiers allow each side of the storage panels that are designed to store objects to be uniquely identified. The colored stickers 176, 178 shown in FIG. 11 are examples of first visual identifiers. As shown in FIG. 11, one colored sticker is provided for each side of the first type of storage panel. The colored stickers are attached to the front edges of the transparent plastic film covering. Hatching shown on the colored stickers represents color. For example, the hatching on colored sticker 176 represents the color orange and the hatching on colored sticker 178 represents the color green. These distinct colors allow each side of the storage panel to be uniquely identified.

A description display is mounted on the door. The description display is a device that allows the user to display a description of the contents of the storage panels, such as a pad of paper 126 shown in FIGS. 12 and 13. The pad of paper has corresponding second visual identifiers 176', and 178' that correspond to the first visual identifiers attached to or integrated into the storage panels. Blank areas 179 are located next to the corresponding second visual identifiers. These blank areas are provided for the user to write descriptions 180 of the objects stored on the storage panels. The pad of paper has a plurality of pages 184 held together with a binding 182. The pad of paper is mounted to the door using an adhesive 186. The pad of paper is mounted on the door with the binding furthest from the hinge so that the pages hang down from the binding when the door is closed.

Operation of a Kitchen Table Embodiment

With a stable support structure and a rigid tabletop, the kitchen table described above is functional in the same manner as other kitchen tables. However, this table also allows a user to store and selectively display objects. The operation of the kitchen table is described below.

Referring to FIG. 1, the user opens the door and removes the storage panels through the opening in the panel housing. FIG. 2 shows the topmost storage panel partially removed. Objects are then stored on the storage panels.

Figure 8:
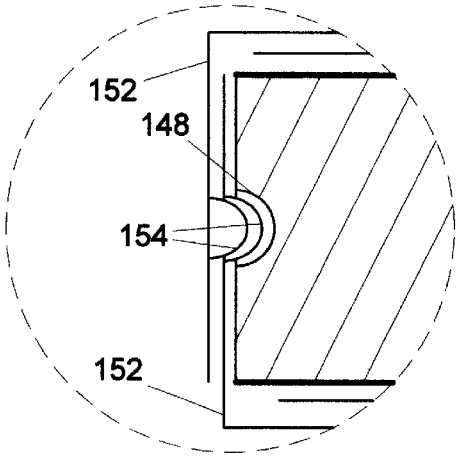
Figure 9:
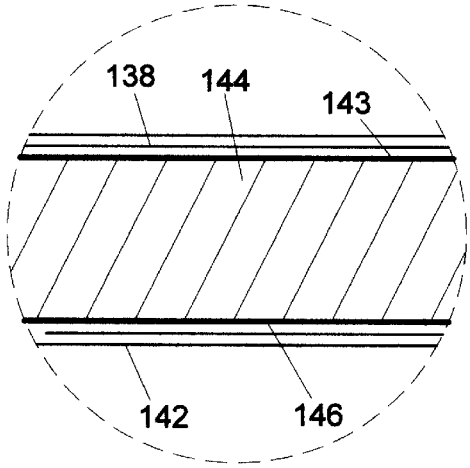
Figure 10:
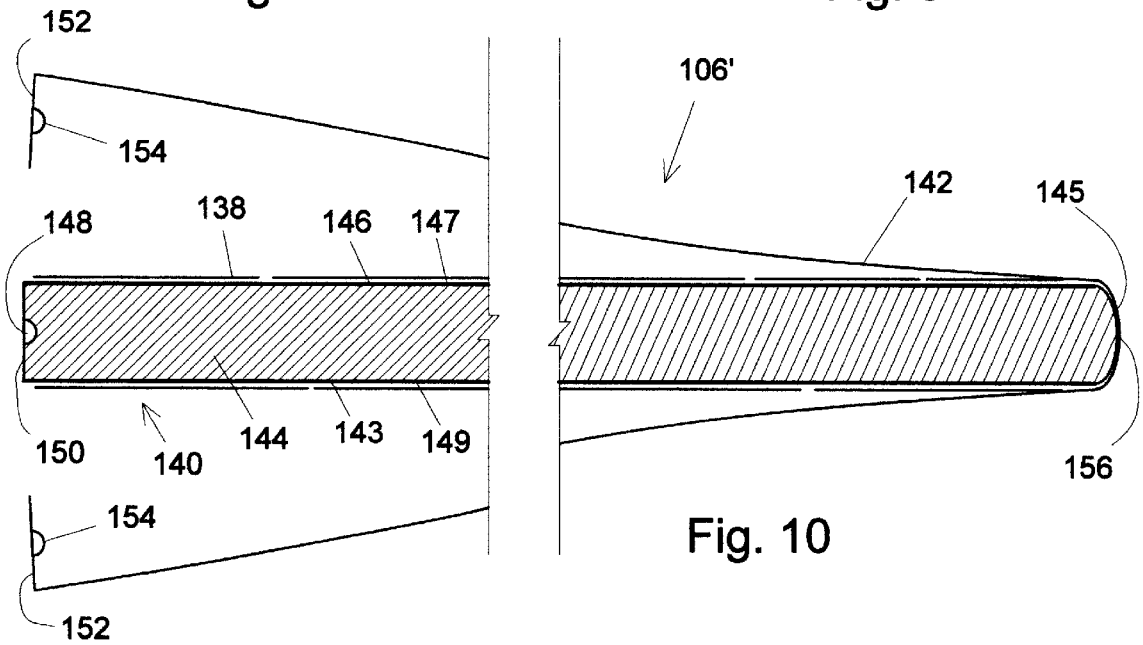

The first type of storage panel allows a user to store a variety of relatively thin objects, such as photographs 138, on both sides 147, 149 of the storage panel. Starting from a closed position shown in FIG. 7, the user disengages the dimpled ends of the transparent plastic film covering as shown in FIG. 10. The user then rotates the transparent plastic film covering about the back edge of the storage panel to expose the surface of the backing. Next, the user selects a suitable arrangement of objects and mounts them to the surface of the backing. The user selects a mounting method that is recommended for each object and the user furnishes all necessary mounting supplies. Choices for mounting methods include photo corners, permanent adhesives, non-permanent adhesives, and double-sided tapes. After mounting the objects on the backing, the transparent plastic film covering is returned to the closed position. This closed position is achieved by pushing one end of the transparent plastic film covering across the front edge of the backing 150 until the dimples on this end engage the concave dimples on the front edge of the backing. Then the other end of the transparent plastic film covering is pushed across the front edge of the backing until the dimples on its ends engage the dimples on the other end of the transparent plastic film covering as shown in FIG. 8.

The second type of storage panel allows the user to store a variety of relatively thin objects, such as baseball cards or stamps, on both sides 167, 169 of the storage panel. Objects are installed into the pockets through the openings.

The third type of storage panel allows a user to store coins on one side of the storage panel. The user places the coins onto the coin retention layer at the holes. The coins are then pushed into the holes. The resulting friction between the coins and the holes secures the coins to the coin retention layer.

After objects have been stored on the storage panels, the user provides a description of the contents of the storage panels on the description display next to the corresponding second visual identifiers. For example, a first visual identifier 178 on the storage panel shown in FIG. 11 is matched with its corresponding second visual identifier 178' on the pad of paper shown in FIG. 12. A description of the contents of this side 147 of the storage panel is written on the pad of paper in the blank area next to the corresponding second visual identifier. Furthermore, on the storage panel shown in FIG. 11, the other first visual identifier 180 is matched with its corresponding second visual identifier 180' on the pad of paper shown in FIG. 12. A description of the contents of this side 149 of the storage panel is written on the pad of paper in the blank area next to the corresponding second visual identifier. This process is continued for each side of the storage panels that is designed to store objects.

The storage panels are then installed into the panel housing through the opening. As the storage panels are slid into the panel housing, the rounded corners on the back edge contact the flexible bulbs of the retainers. As the rounded corners pass by the flexible bulbs, the flexible bulbs are depressed at the point of contact to conform to the rounded corners of the storage panel. After the rounded corners pass by the flexible bulbs, the flexible bulbs align with the notches in the storage panels and return to their original shape. At this point, the storage panels are installed.

Objects on the topside of the topmost storage panel 108 are displayed through the transparent tabletop. To change the objects displayed, the user first selects new objects to be displayed by reading the descriptions of the objects on the description display. After new objects are chosen for display, the corresponding second visual identifier located next to the description of the new objects is matched with the first visual identifier on the storage panel. This selected storage panel is removed through the opening in the panel housing. As the selected storage panel is removed, the flexible bulb is depressed at the point where the selected storage panel contacts the flexible bulb. However, because the flexible bulb is only depressed at this point and remains largely not depressed elsewhere, only the selected storage panel is removed. Other storage panels are retained in the original positions by the flexible bulb. Therefore, the retainer allows the selected storage panel to be removed while the other storage panels remain installed in the panel housing. After the selected storage panel is removed from the panel housing, it is installed as the topmost storage panel 108 with the appropriate side facing up. The objects on this side are then displayed through the transparent tabletop. The door is then closed to isolate and protect the storage panels.

Description of a Dining Table Embodiment

Another embodiment of the storage and display table of the present invention is an expandable dining table 200 illustrated in FIGS. 18 to 31. The expandable dining table is generally comprised of two identical halves 202 that are movably connected and aligned by two pairs of interlocking support rails 204, and a tabletop expansion insert 206.

Figure 19:
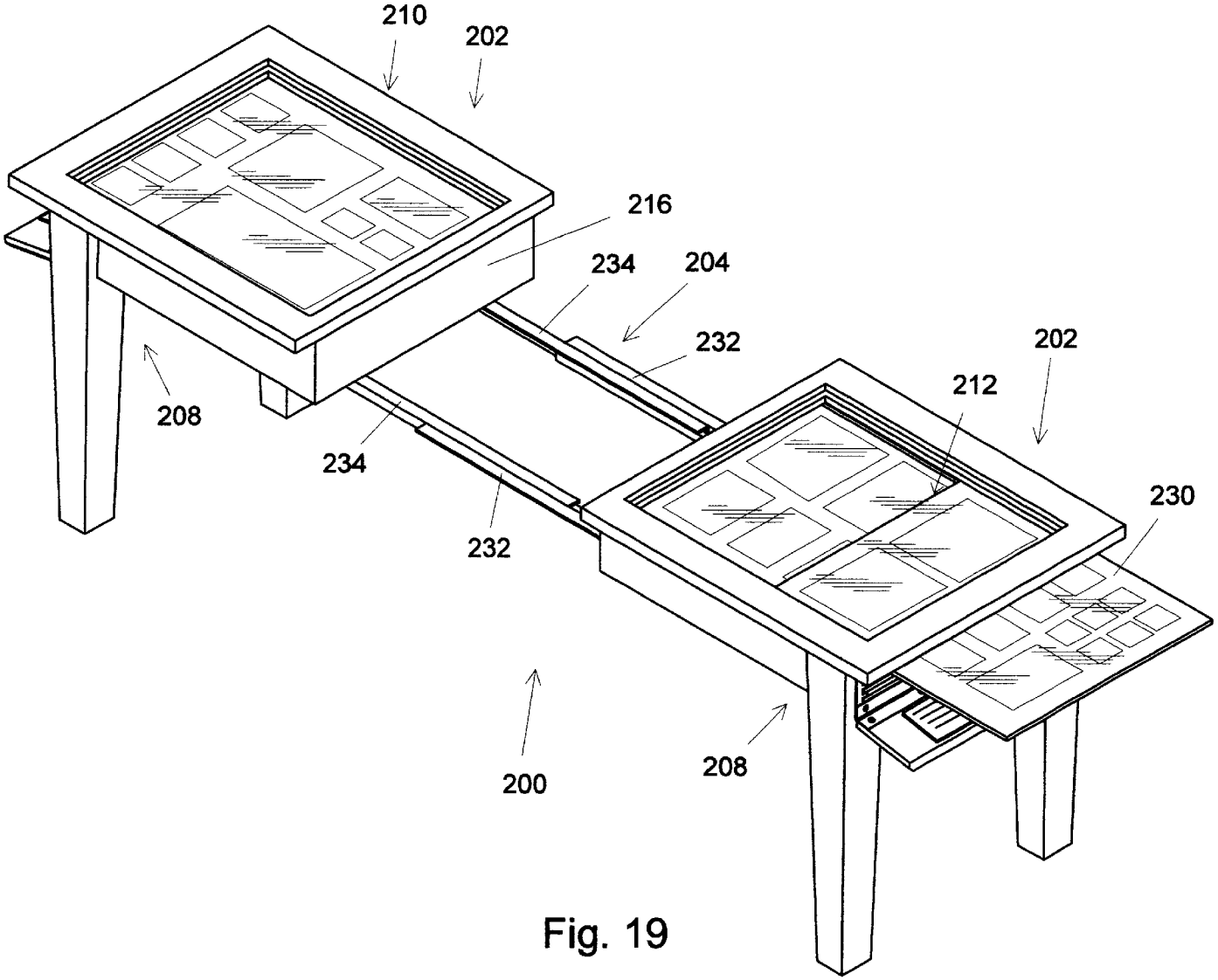
Figure 20:
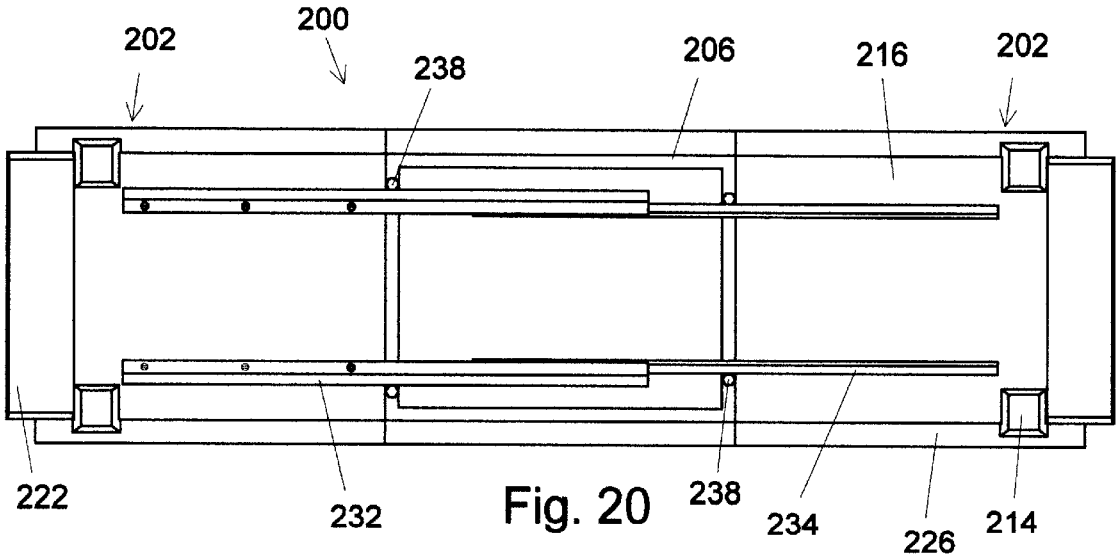
Figure 21:
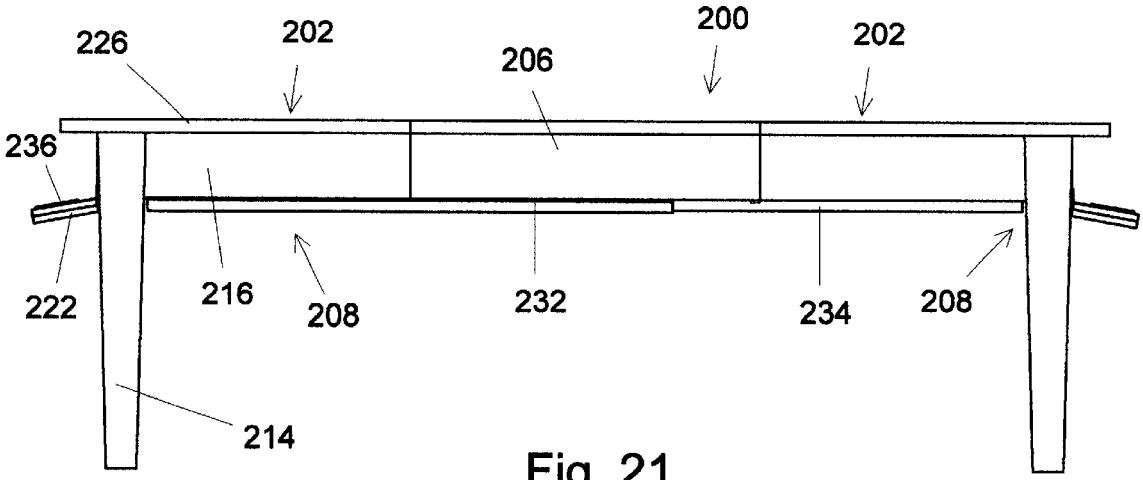

As shown in FIG. 19, each identical half of the dining table 202 is comprised of a support structure 208, a tabletop 210, and a plurality of storage panels 212.

As shown in FIGS. 18 to 24 and FIG. 26, the support structure for each identical half of the expandable dining table is comprised of two legs 214 and a panel housing 216. The legs are mounted to panel housing. The panel housing isolates and protects the storage panels and provides support for the tabletop. A rack 218 is integrated into the panel housing.

Figure 18:
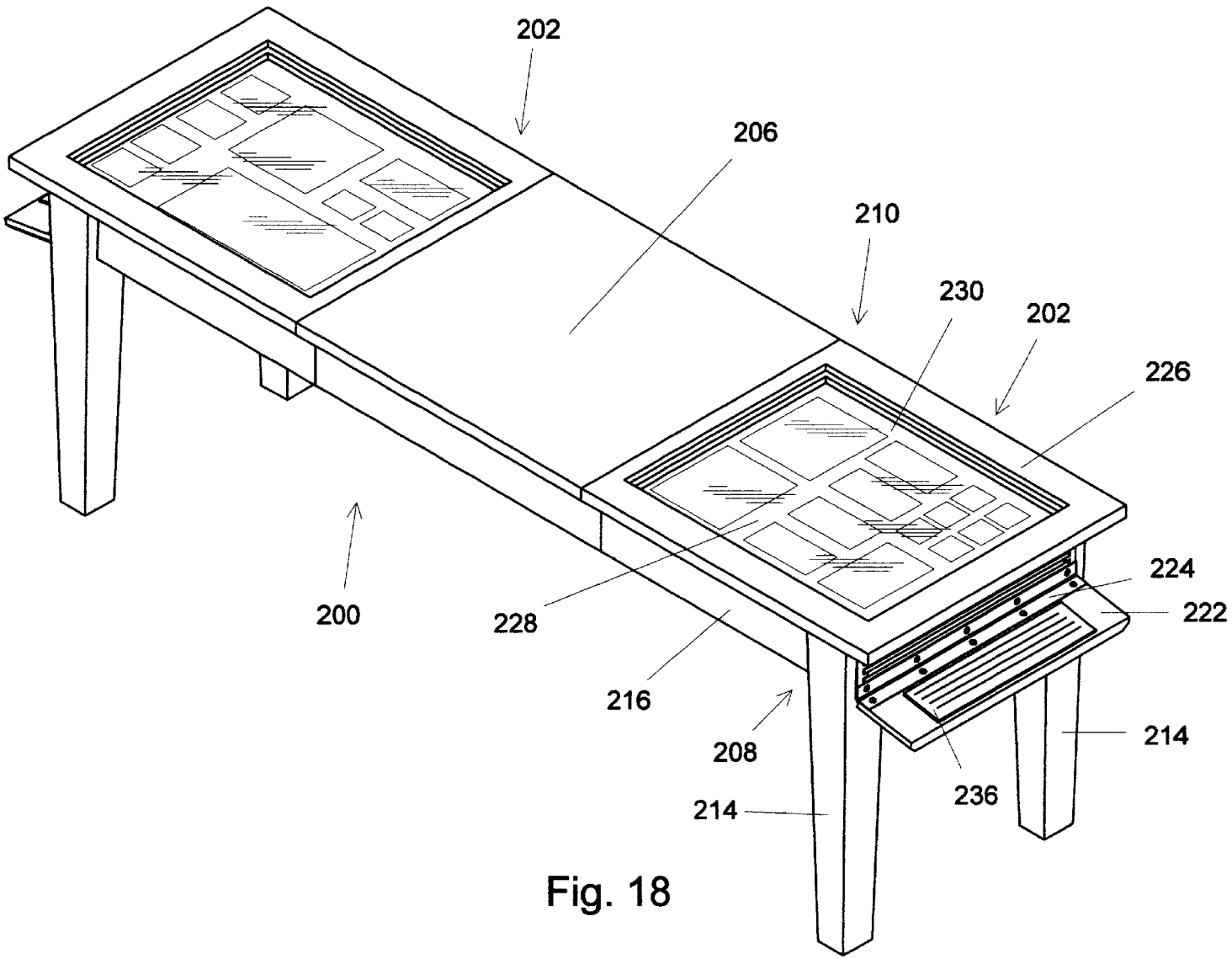
FIGS. 18 to 31 show various aspects of an expandable dining table embodying features of the present invention.
Figure 22:
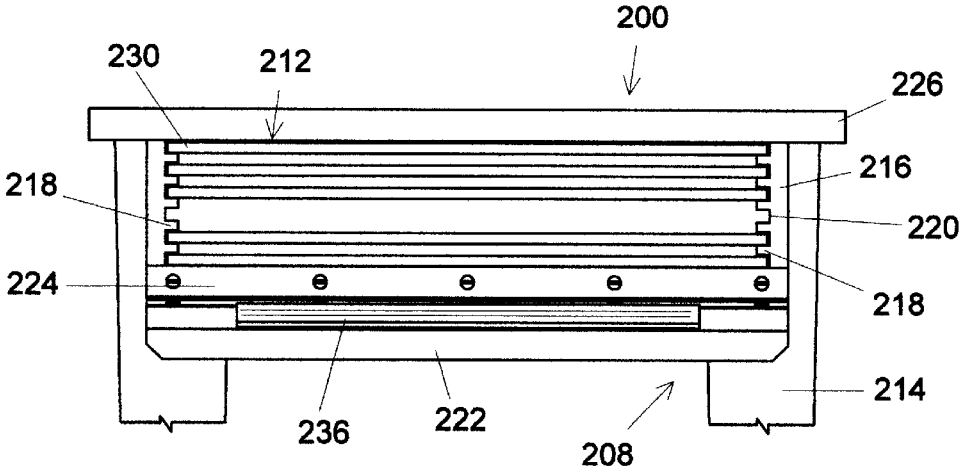
Figure 23:
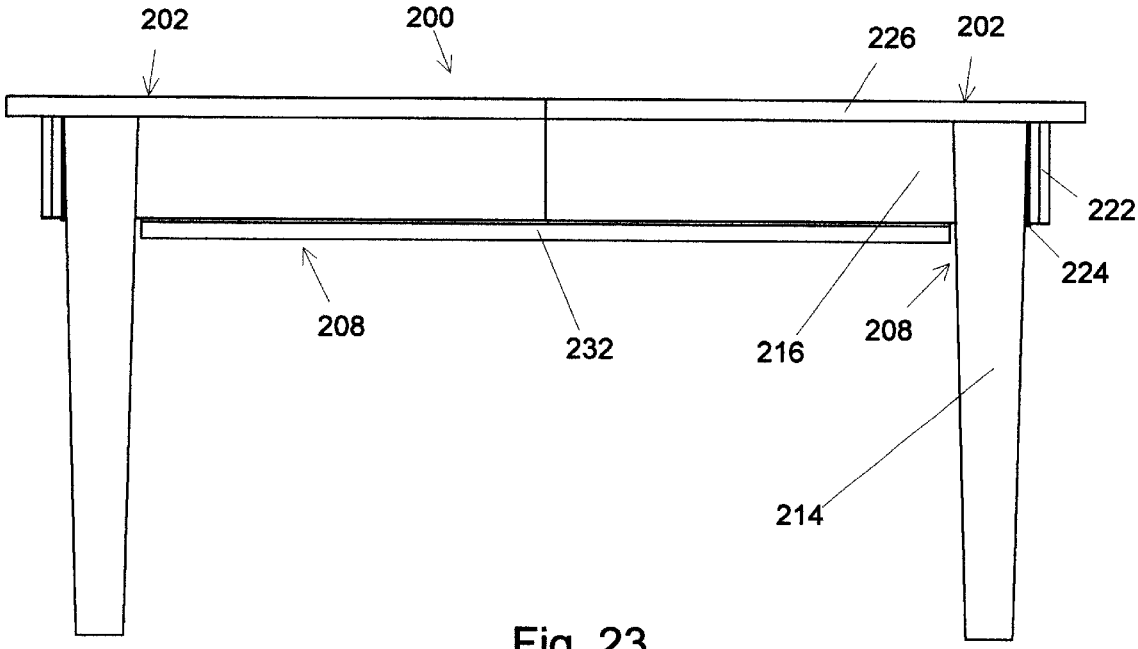
Figure 24:
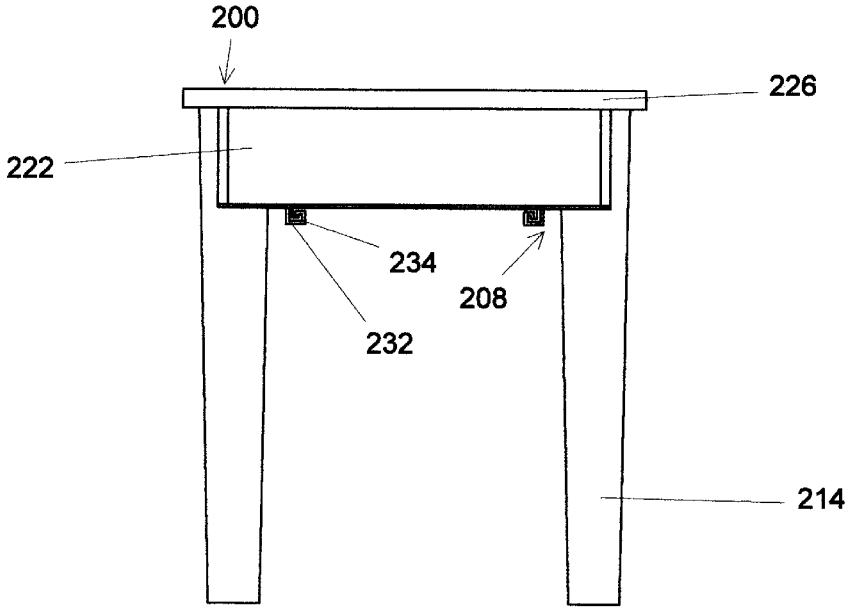
Figure 25:
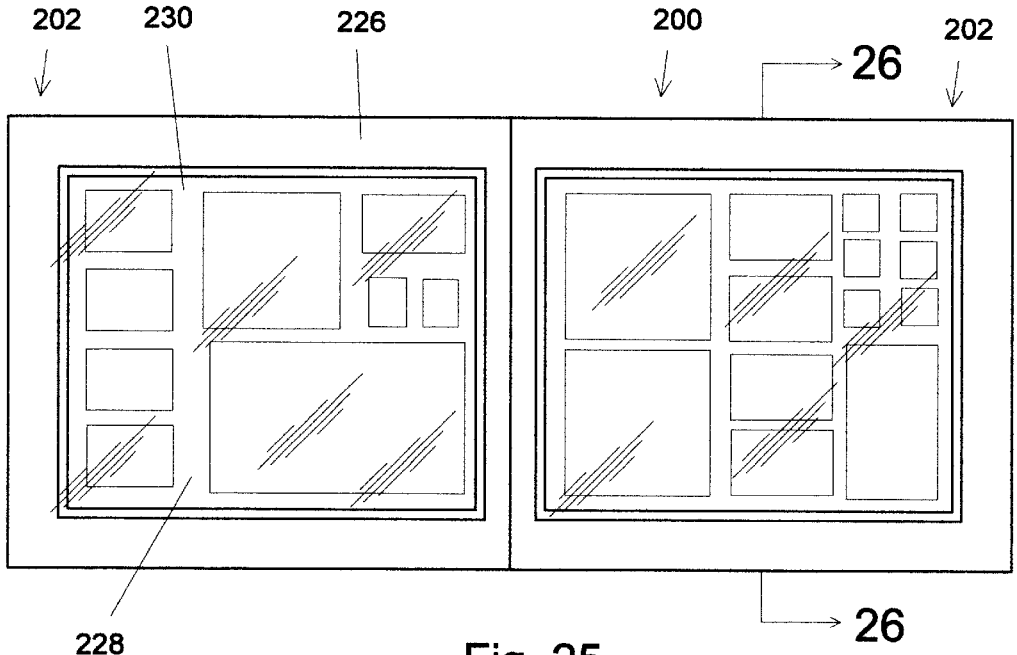

The rack separates and supports each of the storage panels. Referring to FIG. 22, the panel housing has an opening 220 that allows a user to remove and install the storage panels. A door 222 provides a cover for the opening. The door is attached with a hinge 224. The hinge is of the type commonly referred to as a friction hinge. This type of hinge allows the door to be held in any desired position from fully open, as shown in FIG. 18, to fully closed as shown in FIG. 23. The hinge is made of steel and all other components of the support structure are made of wood such as oak. However, any suitable materials can be used to construct the components of the support structure, such as other woods, metals, and plastics.

Figure 26:
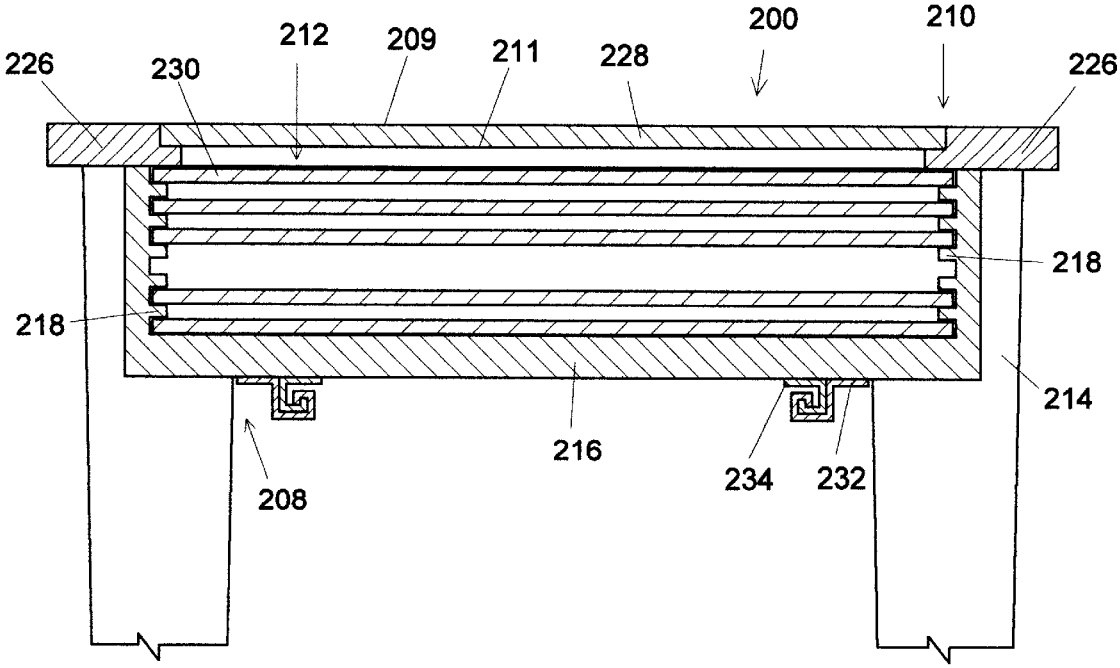

As shown in FIG. 26., the tabletop 210 for each half 202 of the dining table 200 is comprised of a wooden frame 226 and piece of glass 228. The wooden frame is routed to receive and support the piece of glass. The piece of glass has an upper surface 209 and an opposite lower surface 211.

Figure 27:
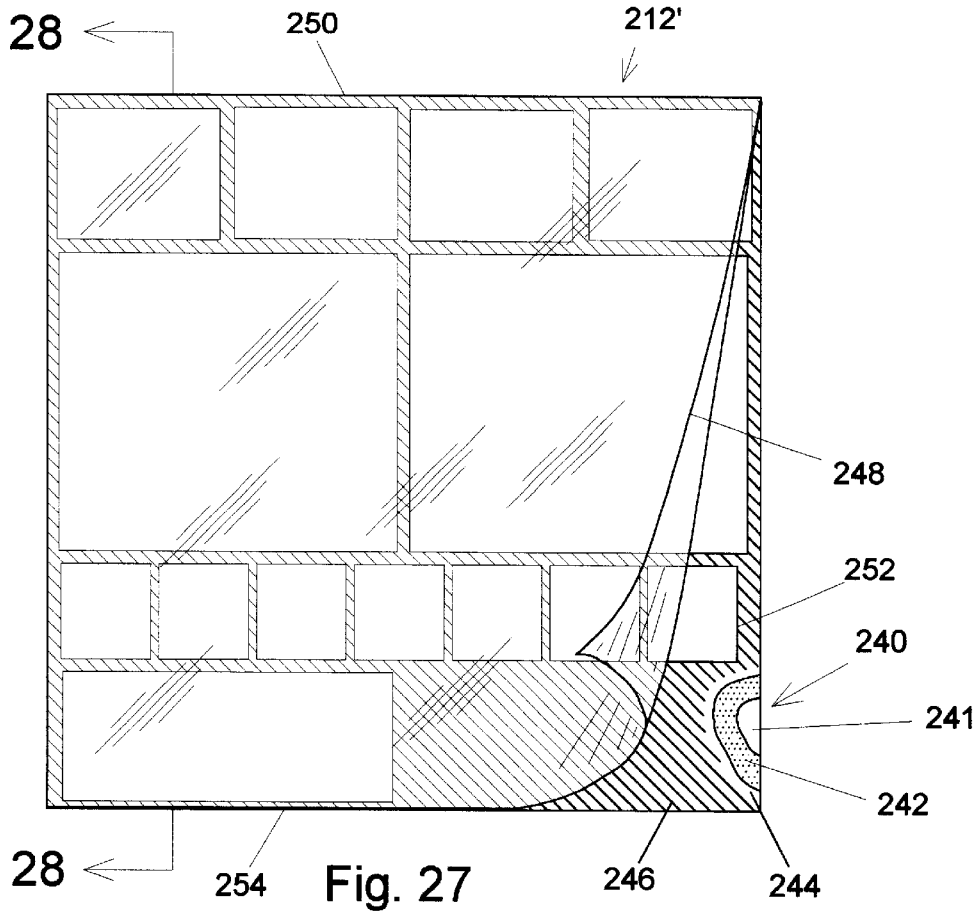
Figure 28:
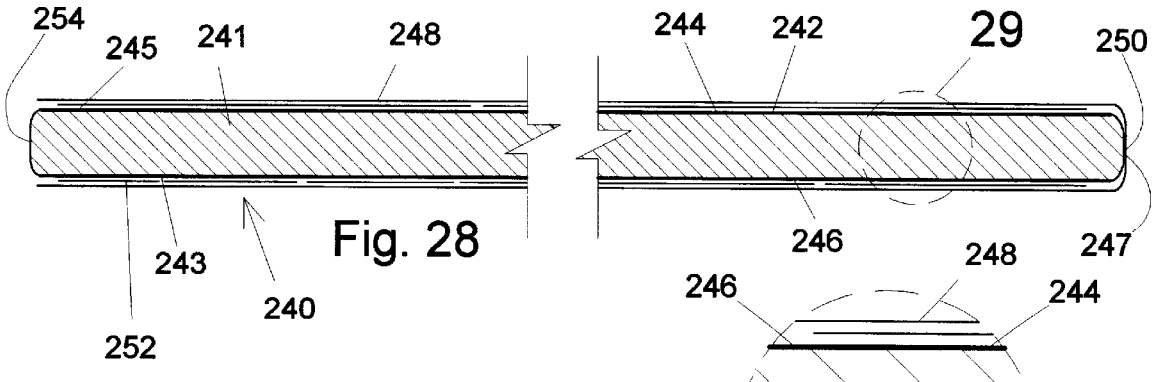
Figure 29:
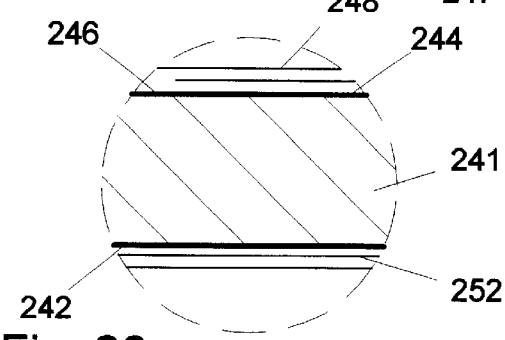

The plurality of storage panels 212 are positioned in the rack below the lower surface 211 of the tabletop. An individual storage panel 212' is shown in FIGS. 27 to 29. The storage panel 212' is comprised of a backing 240, an object adhesive 246, and a transparent plastic film cover 248. The backing comprises a lightweight, rigid center support 241, such as hardboard or foam board, laminated with adhesive 242, between two pieces of archival photo-mount board 244, such as 0.060 inch, 100% cotton rag board. The preferred archival photo-mount board has a PH near neutral to protect objects such as photographs 252 that are stored on the storage panel.

Beads of object adhesive 246 are applied to the archival photo-mount board in a diagonal pattern. The object adhesive is preferably a non-permanent contact adhesive that allows repeated removal and placement of objects. This type of adhesive is commonly referred to by terms such as releasable adhesive, peelable adhesive, or pressure sensitive adhesive. This type of adhesive allows objects to be bonded by surface contact between the object and the adhesive. However, because this bond is not permanent, objects can be easily removed from surface contact with the adhesive without significant adhesive residue remaining on the object.

The transparent plastic film cover 248 wraps around the rear edge 250 of the backing 240 and covers both sides 243, 245 of the backing. Suitable plastics for the transparent plastic film cover include polypropylene, polyethylene, and polyester. The transparent plastic film cover 248 is bonded to the backing with adhesive 247 along the rear edge of the backing, thereby permanently aligning and securing the transparent plastic film cover to the backing.

Figure 30:
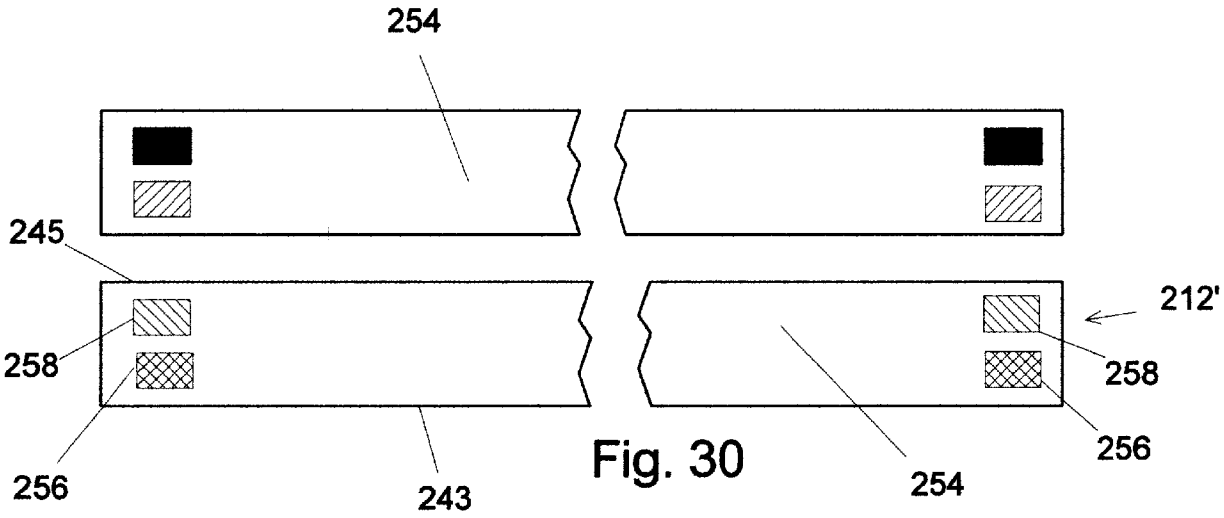
Figure 31:
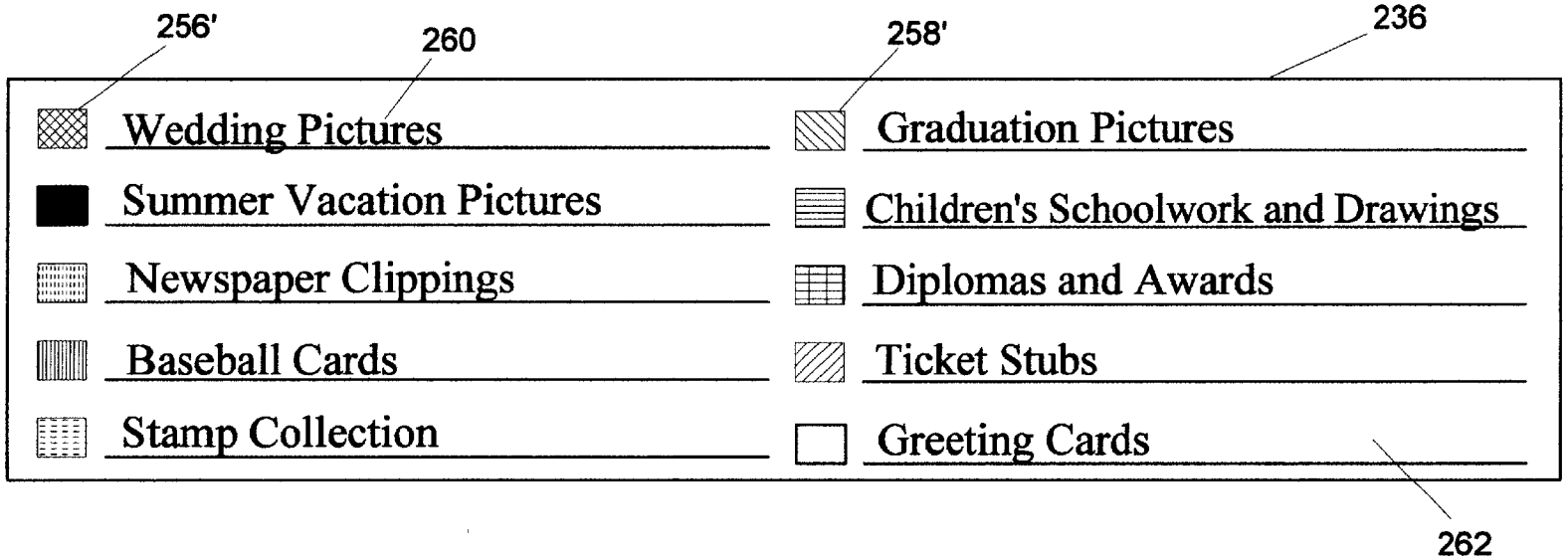
Figure 32:
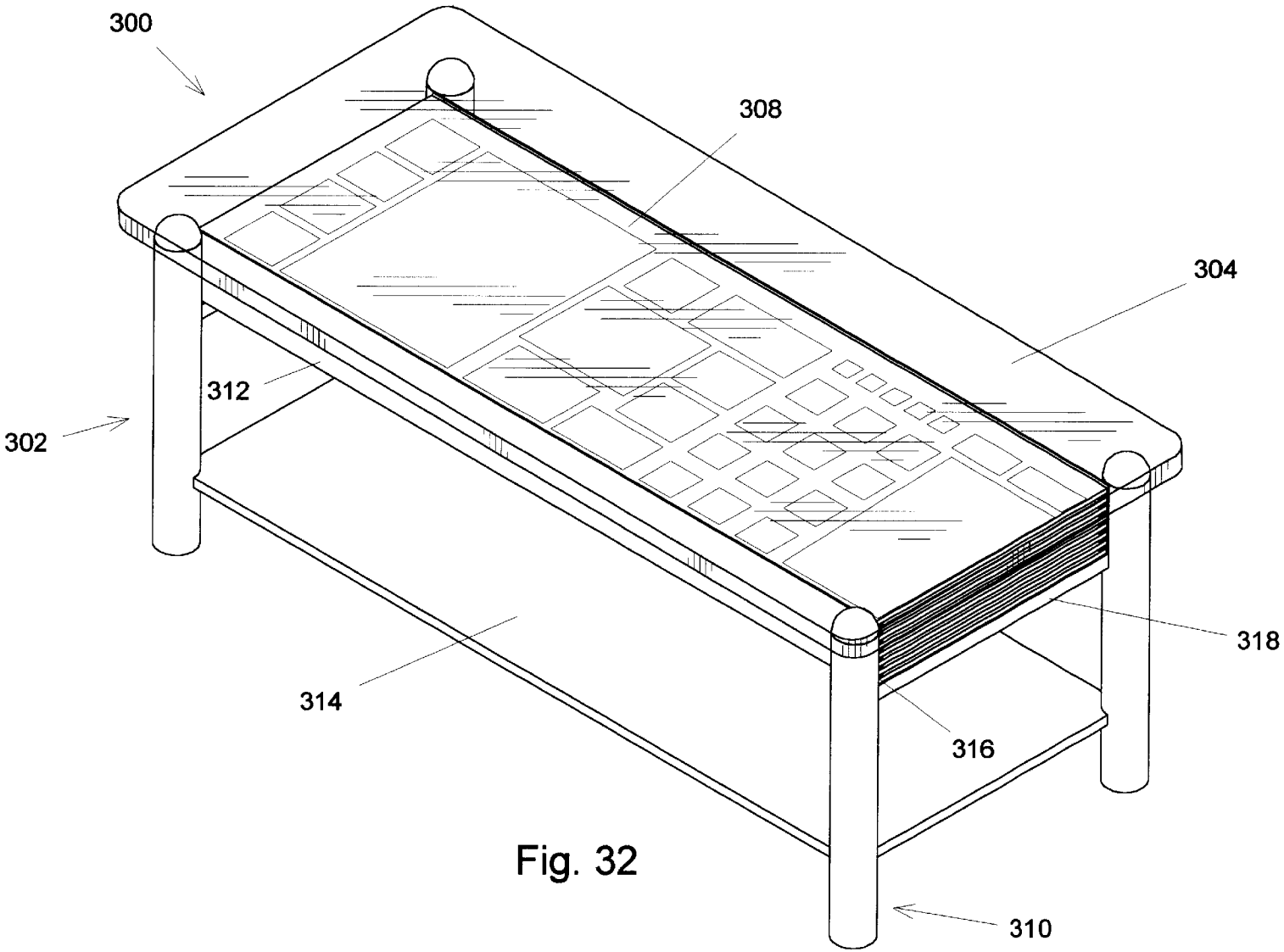
FIGS. 32 to 37 show various aspects of a coffee table embodying features of the present invention.
Figure 33:
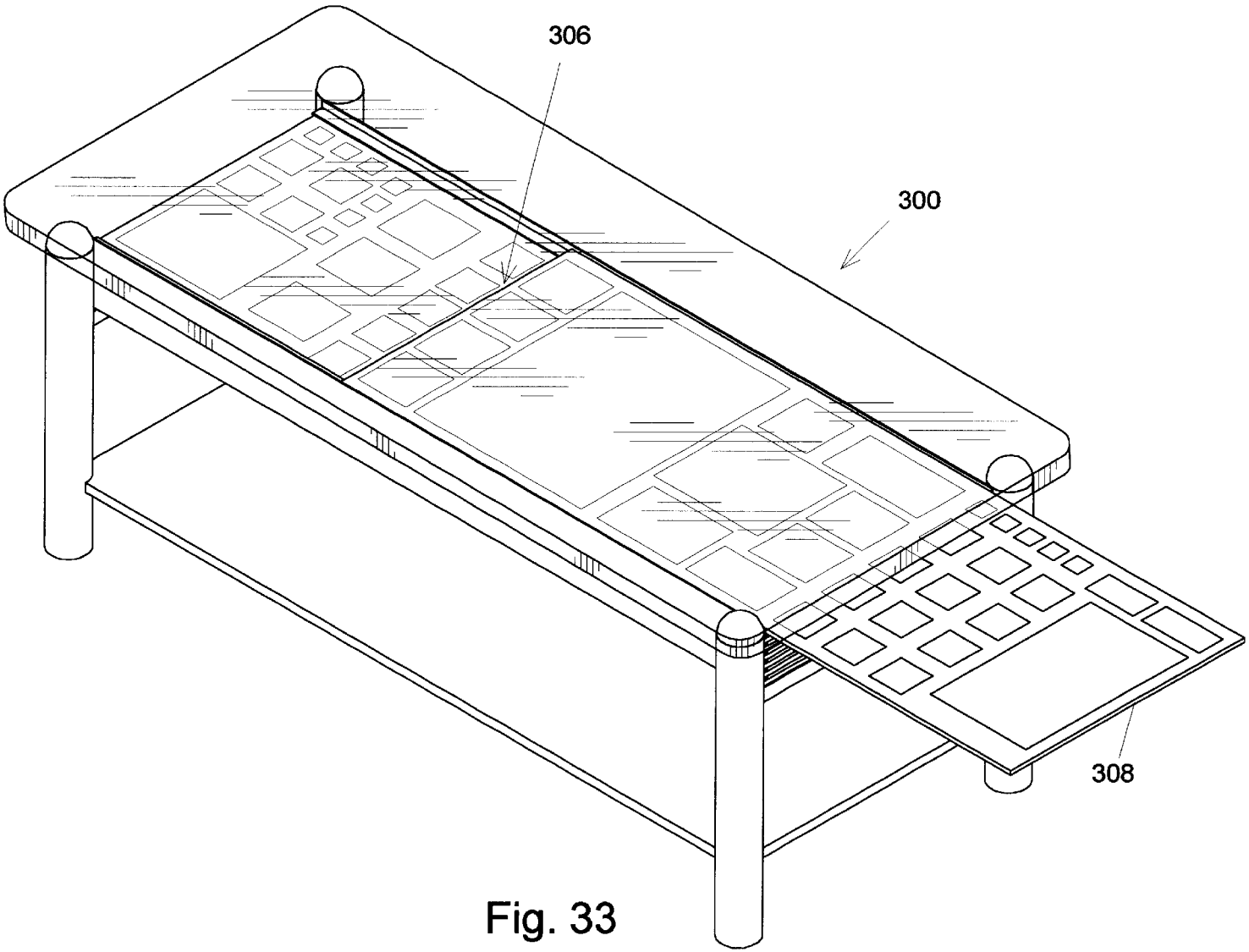
Figure 34:
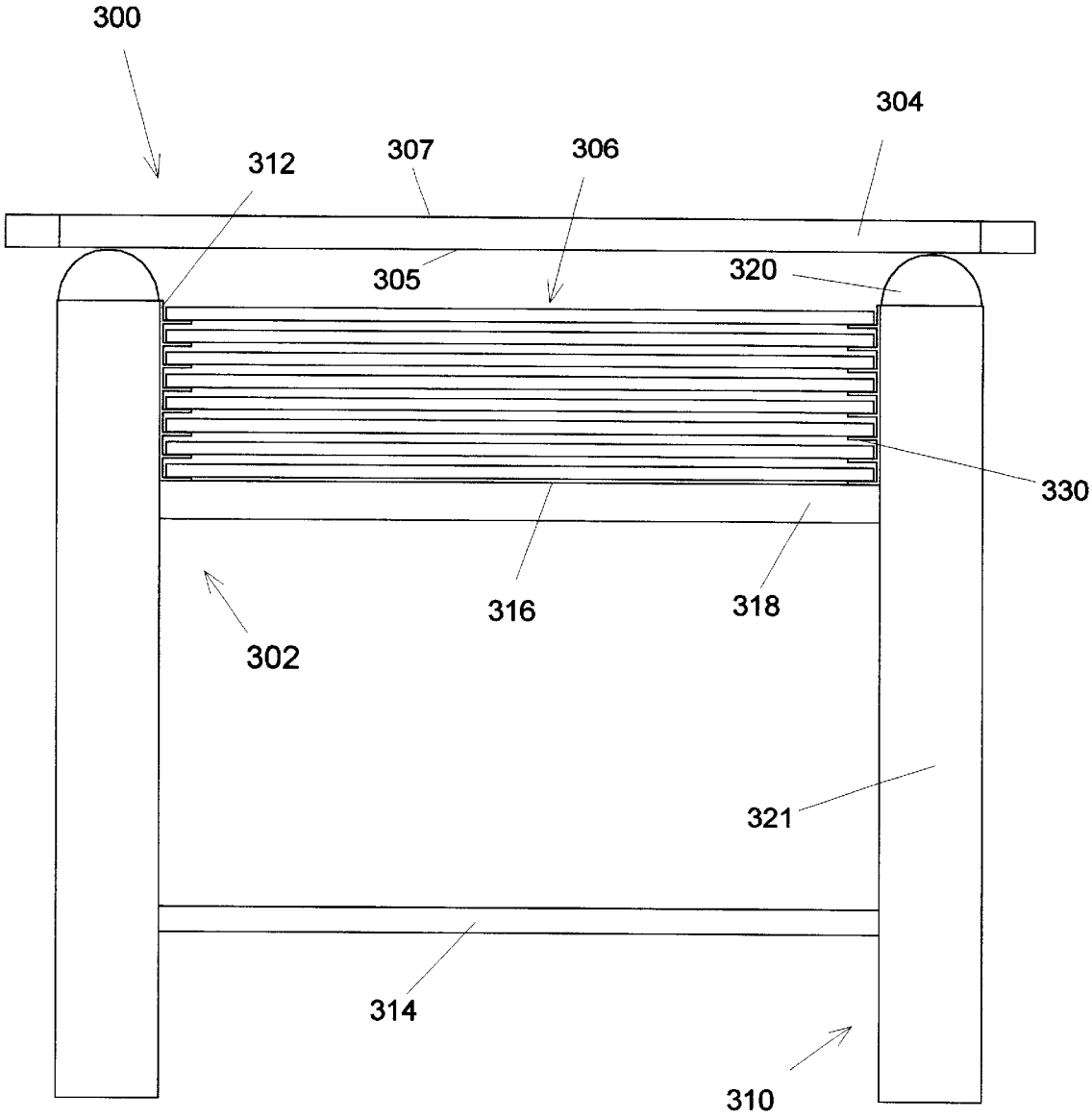

FIG. 30 shows a front view of two storage panels. The storage panels are provided with a pair of first visual identifiers for each side of the storage panel. The first visual identifiers are attached to, or integrated into the storage panels at or near the front edge 254 of the storage panel. Each pair of first visual identifiers has a characteristic, such as color or shape, which distinguishes them from the other visual identifiers. Therefore, the first visual identifiers allow each side of the storage panels to be uniquely identified. The colored stickers 256, 258 shown in FIG. 30 are examples of first visual identifiers. A pair of colored stickers is provided for each side 243, 245 of the storage panel. The colored stickers are attached to the front edge of the backing. As shown in FIG. 30, hatching shown on the colored stickers represents color. For example, the hatching on colored stickers 256 represents the color orange and the hatching on colored stickers 258 represents the color green. These distinct colors allow each side of the storage panel to be uniquely identified.

A description display is provided for each of the identical halves of the table. The description display is a device that allows the user to display a description of the contents of the storage panels, such as the piece of paper 236 shown in FIG. 31. The paper has corresponding second visual identifiers 256', 258' that correspond to the first visual identifiers 256, 258 that are attached to or integrated into the storage panels. Blank areas 262 are located next to the corresponding visual identifiers. These blank areas are provided for the user to write descriptions 260 of the objects stored on the storage panels. As shown in FIG. 26, the paper 236 is attached to the door.

The two sets of interlocking support rails 204 movably connect and align the table halves, and support the tabletop expansion insert. Each set of rails has an inner support rail 234 and an outer support rail 232. The rails are mounted the panel housing with fasteners such as screws. The interlocking rails are made of a strong, rigid material such as steel.

The tabletop expansion insert 206 has four alignment tabs to insure proper positioning. The alignment tabs are durable and easily secured to the support frame, for example hexagon-head bolts 238. The tabletop expansion insert is made of a strong, durable material such as oak.

Operation of a Dining Table Embodiment

With a stable support structure and an expandable tabletop, the dining table described above is functional in the same manner as many other dining tables. However, this table also allows a user to store and selectively display objects. The operation of the dining table is described below.

Referring to FIG. 18, the user opens either of the doors and removes the storage panels through the opening in the panel housing. FIG. 19 shows the topmost storage panel 230 partially removed. Objects are then stored on the storage panels.

The storage panels allow a user to store a variety of relatively thin objects, such as photographs, on both sides 243, 245 of the storage panels. The user peels the transparent plastic film cover from the bond of the object adhesive that is applied to the backing and rotates it about the back edge of the storage panel to expose the object adhesive applied to the surface of the backing. Next, the user arranges objects 252 on the backing. The object adhesive is a non-permanent contact adhesive which allows the user to rearrange objects as needed. After objects are arranged on the backing, the transparent plastic film covering is rotated back over the backing. The transparent plastic film cover contacts the object adhesive applied to the backing in areas that are uncovered by objects, thereby securing the transparent plastic film cover.

After objects have been stored on the storage panels, the user provides a description of the contents of the storage panels on the description display next to the corresponding second visual identifiers. For example, the first visual identifier 256 on the storage panel shown in FIG. 30 is matched with the corresponding second visual identifier on 256' the paper shown in FIG. 31. A description of the contents of this side 243 of the storage panel is written on the paper in the blank area next to the corresponding second visual identifier 256'. Furthermore, the first visual identifier 258 on the storage panel shown in FIG. 30 is matched with the corresponding second visual identifier 258' on the paper shown in FIG. 31. A description of the contents this side 245 of the storage panel is written on the paper in the blank area next to the corresponding second first visual identifier 258'. This process is continued for each side of the storage panels.

The storage panels are then installed into the rack in the panel housing through the opening. Objects on the topside of the topmost storage panel 230 are displayed through the transparent tabletop. To change the objects displayed, the user first selects new objects to be displayed by reading the descriptions of the objects on the paper. After new objects are chosen for display, the corresponding second visual identifier located next to the description of the new objects is matched with the first visual identifier on the storage panel. This selected storage panel is removed through the opening in the panel housing. After the selected storage panel is removed from the panel housing, it is installed as the topmost storage panel 230 with the appropriate side facing up. The objects on this side are then displayed through the transparent tabletop. Other storage panels are stored in the rack below the topmost storage panel. The door is then closed to isolate and protect the storage panels.

To expand the dining table, the two identical halves of the table are pulled apart and the tabletop insert is positioned on the interlocking support rails. The alignment tabs insure proper placement of the tabletop expansion insert.

Description of a Coffee Table Embodiment

Another embodiment of the storage and display table of the present invention is a coffee table 300 illustrated in FIGS. 32 to 37. The coffee table is generally comprised of a support structure 302, a tabletop 304, and a plurality of storage panels 306.

As shown in FIGS. 32 to 35, the support structure 302 comprises four legs 310, two side support members 312, two end braces 318, and a shelf 314. The side support members are mounted to the legs near the top of the legs. The legs are cylindrical posts 321 with hemispherical caps 320. The two end braces are connected to the legs below the side support members. The shelf is joined to the legs near the bottom of the legs. The side support members are made of metal such as aluminum. All other components of the support structure are made of wood, such as oak. However, any suitable materials can be used to construct the support structure such as other woods, metals, or plastics.

Figure 35:
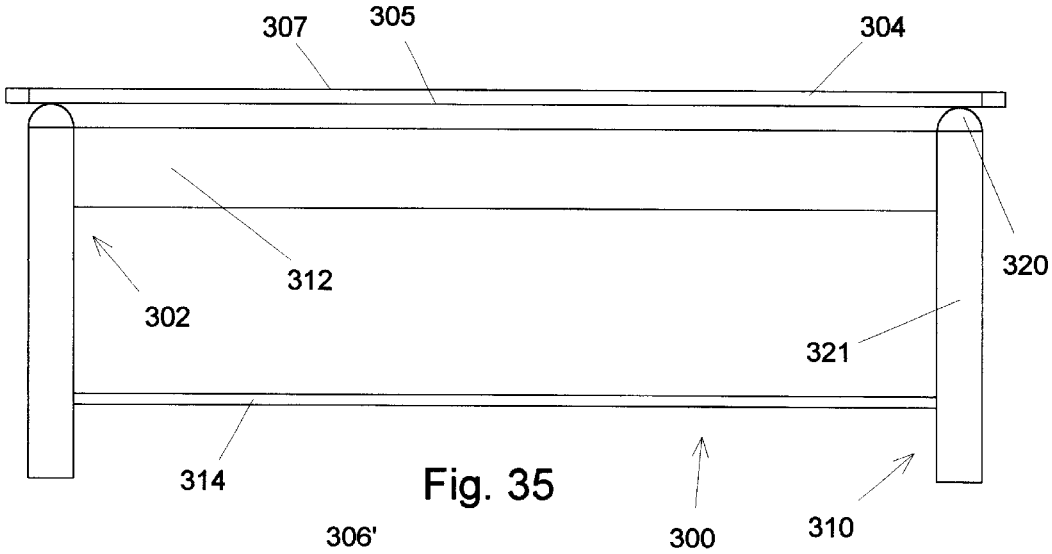

As shown in FIGS. 32 to 35, the tabletop 304 rests on the top of the legs 310. The tabletop is made of glass. Other substantially transparent, rigid materials are suitable, for example plastics. As shown in FIG. 35, the tabletop has an upper surface 307 and an opposite lower surface 305.

Figure 36:
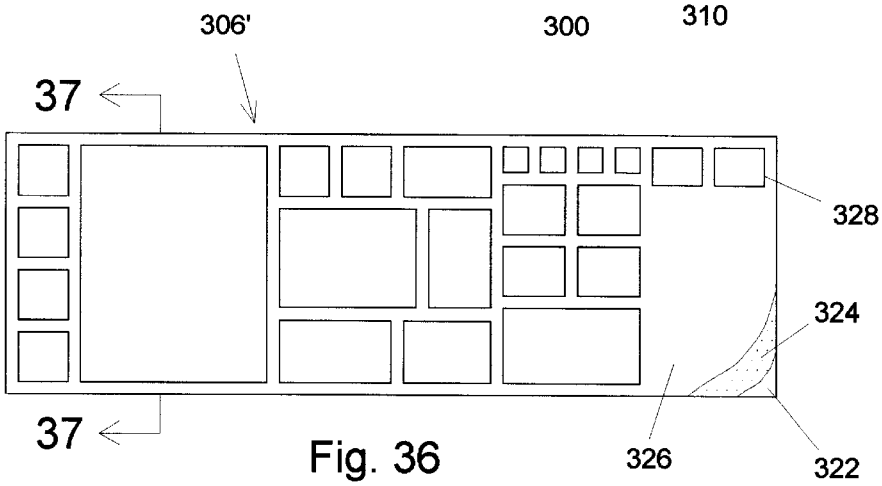
Figure 37:
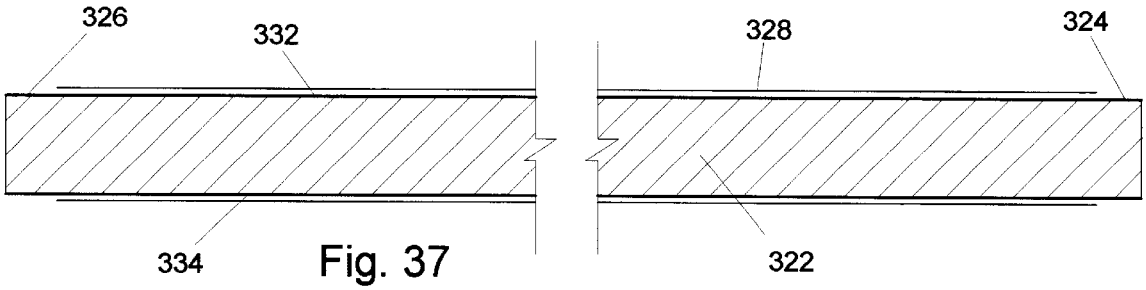

The plurality of storage panels 306 are positioned below the lower surface 305 of the tabletop 304. A rack 330 is located on each of the side support members. These racks separate and support the storage panels. As shown in FIGS. 36 and 37, each storage panel 306' is comprised of a lightweight, rigid backing 322, such as fiberboard or foam, laminated between two pieces of archival photo-mount board 326, such as 0.060 inch, 100% cotton rag board. The preferred archival photo-mount board has a PH near neutral to protect objects such as photographs that are stored on the storage panel. An adhesive 324 is used to laminate the archival photo-mount board to the backing.

Operation of a Coffee Table Embodiment

With features such as a glass tabletop and a shelf, the coffee table embodiment 300 described above functions much like a typical coffee table. However, the coffee table embodiment described above also allows the user to store and selectively display treasured objects, for example photographs.

The storage panels provide the user with a suitable platform for storing and displaying treasured objects 328. Both sides 332, 334 of the storage panels are utilized for storing objects. The user removes the storage panels from the rack through the opening 316. Objects are positioned and repositioned on the storage panels until suitable arrangements are achieved. The user selects a mounting method that is recommended for each object and the user furnishes all necessary mounting supplies. Methods for mounting objects include using photo corners, see-through pouches, non-permanent adhesives, permanent adhesives, and double-sided tape. After objects are mounted to both sides of the storage panels, the storage panels are installed into the rack.

The user can selectively display objects and quickly and easily change the objects 328 displayed. After the selected storage panel is removed from the panel housing, it is installed as the topmost storage panel 308 with the desired objects facing up. These objects are then displayed through the transparent tabletop. Other storage panels are stored in the rack below the topmost panel 308.

Alterations

Figure 38:
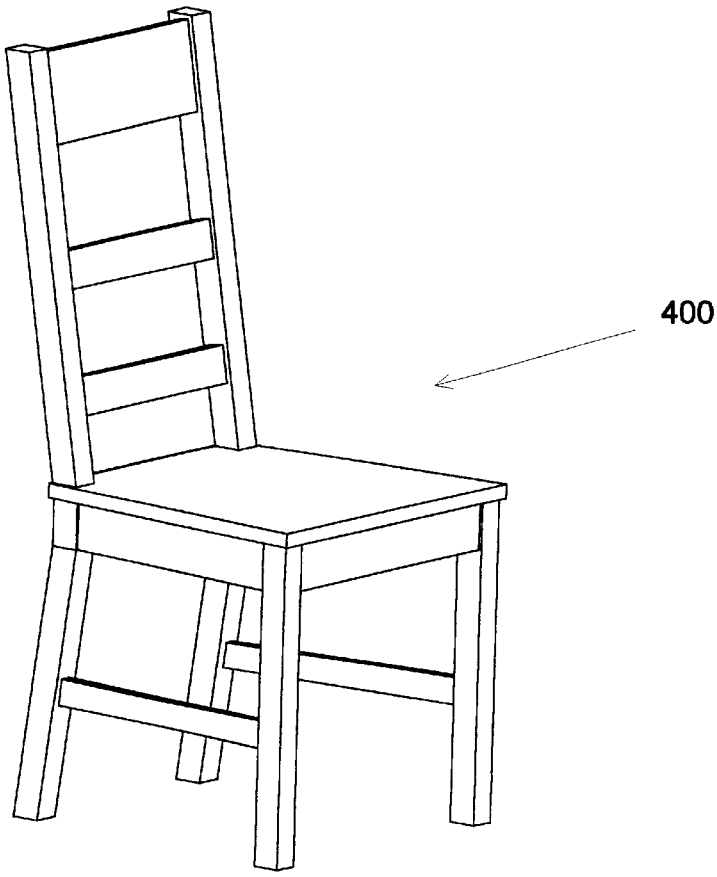
FIG. 38 is a perspective view of a chair having styling similar to the expandable dining table shown in FIG. 18.

Although the description above contains many specificities, these should not be construed as limiting the scope of the invention but as merely providing illustrations of some of the presently preferred embodiments of this invention. For example, the size, shape, form, and style of the tables and the storage panels can be modified to suite the needs and tastes of consumers. Instead of a kitchen, dining, or coffee table, the invention can be provided in the form of another type of table. For example, a coffee table embodiment shown in FIG. 32 can be shortened and provided as an end table. Also, the storage and display table can be provided as a part of a set of similarly styled home furnishings. For example, chairs that are similar in style to a dining table embodiment of the present invention 200 can be provided in order to create what is commonly referred to as a dinette set. An example of such a chair 400 is shown in FIG. 38.

Furthermore, distinguishing features of the three embodiments described and illustrated above can be shared among these three embodiments. For example, the storage panels 106', 106", 106'" of a kitchen table embodiment described above and the storage panel 306' of a coffee table embodiment described above can be modified in size and shape to allow them to be used in an expandable dining table embodiment described above. This table then has modular selection of five different storage panels including storage panel 212'. This modular selection of five storage panels creates a modular storage system that is customizable to suit the needs of the user.

The storage and display table of the present invention can be provided in kit form. For example, the modular selection of storage panels described in the preceding paragraph can be packaged separately for shipment and storage in inventory. From the inventory of these five different storage panels, the user selects any combination of storage panels that best suites his or her storage needs. The remainder of the storage and display table is provided to the user fully assembled. Having received a kit of components consisting of separately packaged storage panels and the fully assembled remainder of the storage and display table, the user installs the storage panels into the fully assembled remainder of the storage and display table to complete the table. By providing the table in kit form, the user can select a kit of components that assemble into a completed storage and display table that best meets the user's needs.

An additional benefit to having the modular selection of storage panels separately packaged and stored in inventory is that the storage panels can be sold separately. This allows the user to purchase new storage panels from the modular selection of storage panels as the user's storage needs change with time. These new storage panels replace existing storage panels that no longer meet the storage needs of the user. The inventory of storage panels can be changed to meet the changing needs of the user over time.

Figure 39:
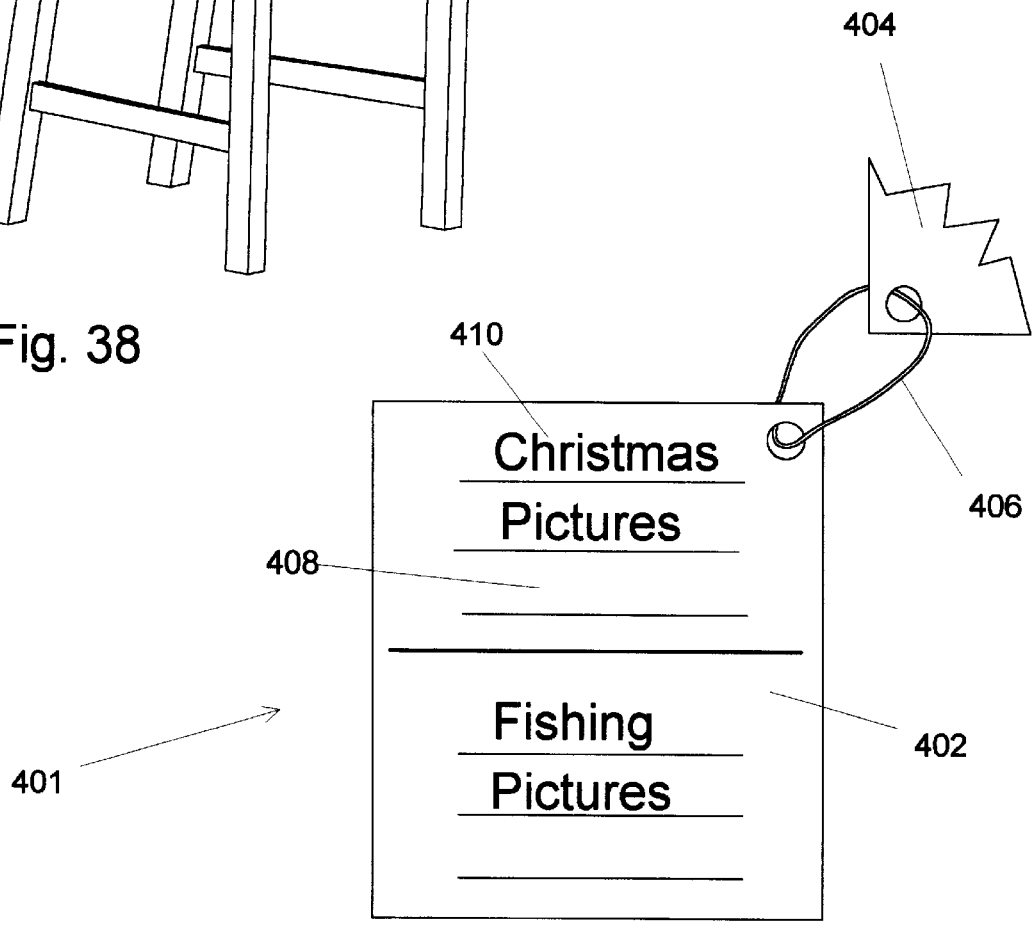
FIG. 39 is a top view of a tag.

Also, instead of mounting a description display on a door, a description display could be attached to a storage panel. With this approach, the visual identifiers are not needed. For example, the tag 401 shown in FIG. 39 could be attached to a storage panel 404 using a string 406. The tag is a durable substrate 402, such as thick paper, with blank areas 408 for writing descriptions 410 of the contents of the storage panel 404.

The mounting methods chosen by the user to mount objects to storage panels 106' and 306' are not part of the present invention. Examples of such mounting methods are provided above to illustrate commonly used mounting techniques. However, mounting methods recommended for the user's particular objects should be used.

Conventional materials, components, and methods can be used to construct the storage and display table of the present invention. Substitute materials, components, and methods are commonly known and used in the art. Therefore, the specific materials, components, and methods described above are not essential for practicing the present invention.

Thus the scope of the invention should be determined by the appended claims and their legal equivalents, rather than by the many specific examples provided herein for illustration.

Conclusions

After examining three possible embodiments and several alterations of these three possible embodiments of the present invention as provided above, the reader can more clearly appreciate the advantages of the present invention. These advantages include:

- it provides a convenient, protected location to store and display treasured objects.
- it provides a large amount of storage area for storing many treasured objects.
- it provides easy access to the treasured objects and allows the user to quickly and easily change the treasured objects displayed from one set of treasured objects to another set.

it provides a large display area which allows for greater flexibility when arranging groups of treasured objects for display.

it provides storage and selective display of many disparate objects, for example coins, photographs, stamps, and trading cards.

it provides a visual identification system to quickly and easily identify the contents of the storage panels.

it provides a modular storage system that is customizable to meet the storage needs of the individual user.

it provides a modular selection of storage panels that can be changed to meet the changing storage needs of the user over time.

it provides storage and display of treasured objects at a tabletop where guests often gather to enjoy refreshments and conversation.

The present invention does not require that all the advantages need to be incorporated into every embodiment of the present invention. By examining the appended claims, additional embodiments and advantages of the present invention become apparent. Thus, one can see that embodiments of the present invention satisfy the need for an improved device for storing and displaying treasured objects.

What is claimed is:

1. A household table that provides convenient storage and display for thin, chartaceous objects of a household, the table comprising:

a tabletop having an upper surface and an opposite lower surface, the tabletop being at least partially constructed of a substantially transparent material allowing a user to see below the lower surface of the tabletop from above the upper surface of the tabletop;

one or more substantially planar, easily portable storage panels that provide the household convenient storage and display for the thin, chartaceous objects of the household, the one or more easily portable storage panels comprising:

a lightweight, thin backing having substantial rigidity on which the thin, chartaceous objects are arranged and secured; and a transparent plastic film covering formed into a plurality of pockets to protect the arrangement of thin, chartaceous objects; and a support structure configured to support the tabletop and support the one or more easily portable storage panels below the lower surface of the tabletop such that at least one of the one or more easily portable storage panels is proximate the lower surface of the substantially transparent material of the tabletop, the support structure having an opening allowing the user to remove and install the one or more easily portable storage panels to manage the objects thereon and to arrange the one or more easily portable storage panels to selectively display the objects through the substantially transparent material of the tabletop, whereby the household is provided the table that conveniently stores and displays thin, chartaceous objects of the household on the lightweight, easily portable storage panels.

2. The household table of claim 1, wherein the household table is provided in the form of a kitchen table, a dining table, or a coffee table.

3. The household table of claim 1 further comprising means for displaying a description of thin, treasured objects on the easily portable storage panels.

4. The household table of claim 1 further comprising a rack for the easily portable storage panels.

5. The household table of claim 1 further comprising a retainer to facilitate individual removal of the easily portable storage panels.

6. The household table of claim 1 wherein the household table is part of a set of similarly styled home furnishings.

7. The household table of claim 1 wherein the household table is provided as a kit of components.

8. The household table of claim 7 wherein the components of the kit are selected by the user from a modular set of components including a modular set of the easily portable storage panels, whereby the user is allowed to select the easily portable storage panels that suit the storage and display needs of the user.

9. The household table of claim 1 further comprising a storage panel selected from a group consisting of a first, a second, a third, a fourth, and a fifth storage panel wherein the first storage panel comprises a backing having a plurality of hollow retainers configured to hold coins;

the second storage panel comprises a lightweight backing having substantial rigidity on which the thin, chartaceous objects are arranged and secured; and a transparent plastic film covering to protect the arrangement of thin, chartaceous objects;

the third storage panel comprises a lightweight, substantially rigid backing part; and a substantially neutral PH surface part laminated to the backing part for mounting thin, chartaceous objects;

the fourth storage panel comprises a lightweight, substantially rigid backing part having a non permanent contact adhesive applied thereon for securing thin, chartaceous objects;

and a transparent plastic film covering to protect the arrangement of thin, chartaceous objects; and the fifth storage panel comprises a lightweight backing having substantial rigidity on which the thin, chartaceous objects are arranged and secured;

a transparent plastic film covering to protect the arrangement of thin, chartaceous objects, the transparent plastic film covering having at least one movable end; and means for retaining the at least one movable end proximate the backing.

10. The household table of claim 9 wherein the household table is provided as a kit of components.

11. The household table of claim 10 wherein the components of the kit are selected by the user from a modular set of components including a modular set of the easily portable storage panels, whereby the user is allowed to select the easily portable storage panels that suit the storage and display needs of the user.

12. A household table that provides convenient storage and display for thin, chartaceous objects of a household, the table comprising:

a tabletop having an upper surface and an opposite lower surface, the tabletop being at least partially constructed of a substantially transparent material allowing a user to see below the lower surface of the tabletop from above the upper surface of the tabletop;

one or more substantially planar, easily portable storage panels that provide the household convenient storage and display for the thin, chartaceous objects of the household, the one or more easily portable storage panels comprising:

a lightweight, thin backing having substantial rigidity on which the thin, chartaceous objects are arranged and secured;

a transparent plastic film covering to protect the arrangement of thin, chartaceous objects, the transparent plastic film covering having at least one movable end; and means for retaining the at least one movable end proximate the backing; and a support structure configured to support the tabletop and support the one or more easily portable storage panels below the lower surface of the tabletop such that at least one of the one or more easily portable storage panels is proximate the lower surface of the substantially transparent material of the tabletop, the support structure having an opening allowing the user to remove and install the one or more easily portable storage panels to manage the objects thereon and to arrange the one or more easily portable storage panels to selectively display the objects through the substantially transparent material of the tabletop, whereby the household is provided the table that conveniently stores and displays thin, chartaceous objects of the household on the lightweight, easily portable storage panels.

13. The household table of claim 12 wherein the household table is provided in the form of a kitchen table, a dining table, or a coffee table.

14. The household table of claim 12 further comprising means for displaying a description of thin, treasured objects on the easily portable storage panels.

15. The household table of claim 12 further comprising a rack for the easily portable storage panels.

16. The household table of claim 12 further comprising a retainer to facilitate individual removal of the easily portable storage panels.

17. The household table of claim 12 wherein the household table is part of a set of similarly styled home furnishings.

18. The household table of claim 12 wherein the household table is provided as a kit of components.

19. The household table of claim 12 further comprising a storage panel selected from a group consisting of a first, a second, a third, a fourth, and a fifth storage panel wherein the first storage panel comprises a backing having a plurality of hollow retainers configured to hold coins;

the second storage panel comprises a lightweight backing having substantial rigidity on which the thin, chartaceous objects are arranged and secured; and a transparent plastic film covering to protect the arrangement of thin, chartaceous objects;

the third storage panel comprises a lightweight, substantially rigid backing part; and a substantially neutral PH surface part laminated to the backing part for mounting thin, chartaceous objects;

the fourth storage panel comprises a lightweight, substantially rigid backing part having a non permanent contact adhesive applied thereon for securing thin, chartaceous objects;

and a transparent plastic film covering to protect the arrangement of thin, chartaceous objects; and the fifth storage panel comprises a lightweight backing having substantial rigidity on which the thin, chartaceous objects are arranged and secured; and a transparent plastic film covering formed into a plurality of pockets to protect the arrangement of thin, chartaceous objects.

20. The household table of claim 19 wherein the household table is provided as a kit of components.

21. The household table of claim 20 wherein the components of the kit are selected by the user from a modular set of components including a modular set of the easily portable storage panels, whereby the user is allowed to select the easily portable storage panels that suit the storage and display needs of the user.

22. A household table that provides convenient storage and display for thin, chartaceous objects of a household, the table comprising:

a tabletop having an upper surface and an opposite lower surface, the tabletop being at least partially constructed of a substantially transparent material allowing a user to see below the lower surface of the tabletop from above the upper surface of the tabletop;

one or more substantially planar, easily portable storage panels that provide the household convenient storage and display for the thin, chartaceous objects of the household, the one or more easily portable storage panels comprising:

a lightweight, thin backing having substantial rigidity and having first and second sides of greatest area on which the thin, chartaceous objects are arranged and secured; and a flexible, transparent plastic film covering the first and second sides of greatest area to protect the arrangement of thin, chartaceous objects; and a support structure configured to support the tabletop and support the one or more easily portable storage panels below the lower surface of the tabletop such that at least one of the one or more easily portable storage panels is proximate the lower surface of the substantially transparent material of the tabletop, the support structure having an opening allowing the user to remove and install the one or more easily portable storage panels to manage the objects thereon and to arrange the one or more easily portable storage panels to selectively display the objects through the substantially transparent material of the tabletop, whereby the household is provided the table that conveniently stores and displays thin, chartaceous objects of the household on the lightweight, easily portable storage panels.

23. The household table of claim 22 wherein the household table is provided in the form of a kitchen table, a dining table, or a coffee table.

24. The household table of claim 22 further comprising means for displaying a description of thin, treasured objects on the easily portable storage panels.

25. The household table of claim 22 further comprising a rack for the easily portable storage panels.

26. The household table of claim 22 further comprising a retainer to facilitate individual removal of the easily portable storage panels.

27. The household table of claim 22 wherein the household table is part of a set of similarly styled home furnishings.

28. The household table of claim 22 wherein the household table is provided as a kit of components.

29. The household table of claim 22 further comprising a storage panel selected from a group consisting of a first, a second, a third, a fourth, a fifth, and a sixth storage panel wherein the first storage panel comprises a backing having a plurality of hollow retainers configured to hold coins;

the second storage panel comprises a lightweight backing having substantial rigidity on which the thin, chartaceous objects are arranged and secured; and a transparent plastic film covering to protect the arrangement of thin, chartaceous objects;

the third storage panel comprises a lightweight, substantially rigid backing part; and a substantially neutral PH surface part laminated to the backing part for mounting thin, chartaceous objects;

the fourth storage panel comprises a lightweight, substantially rigid backing part having a non permanent contact adhesive applied thereon for securing thin, chartaceous objects;

and a transparent plastic film covering to protect the arrangement of thin, chartaceous objects;

the fifth storage panel comprises a lightweight backing having substantial rigidity on which the thin, chartaceous objects are arranged and secured;

a transparent plastic film covering to protect the arrangement of thin, chartaceous objects, the transparent plastic film covering having at least one movable end; and means for retaining the at least one movable end proximate the backing; and the sixth storage panel comprises a lightweight, thin backing having substantial rigidity on which the thin, chartaceous objects are arranged and secured; and a transparent plastic film covering formed into a plurality of pockets to protect the arrangement of thin, chartaceous objects.

30. The household table of claim 29 wherein the household table is provided as a kit of components.

31. The household table of claim 30 wherein the components of the kit are selected by the user from a modular set of components including a modular set of the easily portable storage panels, whereby the user is allowed to select the easily portable storage panels that suit the storage and display needs of the user.

* * * * *